US006868944B2

(12) United States Patent
Truckner et al.

(10) Patent No.: US 6,868,944 B2
(45) Date of Patent: Mar. 22, 2005

(54) ADJUSTABLE STAIR STRINGER AND RAILING

(75) Inventors: Richard Truckner, Hayward, CA (US); Paul Truckner, Hayward, CA (US)

(73) Assignee: EZ Stairs, Inc., Laguna Hills, CA (US)

( * ) Notice: Subject to any disclaimer, the term of this patent is extended or adjusted under 35 U.S.C. 154(b) by 47 days.

(21) Appl. No.: 10/095,780

(22) Filed: Mar. 9, 2002

(65) Prior Publication Data

US 2002/0088669 A1 Jul. 11, 2002

Related U.S. Application Data

(63) Continuation-in-part of application No. 09/315,809, filed on May 21, 1999, now Pat. No. 6,354,403.
(60) Provisional application No. 60/085,151, filed on May 21, 1998.

(51) Int. Cl.[7] ..... E04F 11/00
(52) U.S. Cl. ..... 182/228.1; 52/183
(58) Field of Search ..... 182/1, 228.1; 52/182–191

(56) References Cited

U.S. PATENT DOCUMENTS 1,189,514 A * 7/1916 Wallace ..... 182/1
4,124,957 A * 11/1978 Poulain ..... 52/183
5,636,483 A * 6/1997 Wille ..... 52/188

* cited by examiner

*Primary Examiner*—Alvin Chin-Shue
(74) *Attorney, Agent, or Firm*—George W. Wasson

(57) ABSTRACT

An adjustable stair stringer and railing construction assembly is disclosed. The assembly is adapted to use a pair of parallel stringer arms for each side of the stair, a riser/tred support bracket for each stair and alignment and spacing elements for spacing the support brackets along the stringers. The brackets include formations for spacing the stringers with respect to each other and for spacing adjacent brackets along the stringers. The brackets are initially pivotally attached to each of the stringers so as to be rotatably movable about their pivotal attachment as the stringers are moved axially. Axial movement of the stringers with respect to each other establishes the angle of rise of the stair. Treads and risers are attached to the brackets to form the stairs and railings are attachable to the stringer and bracket assembly to complete the construction. The parallel stringers, brackets and spacers are also used in the preparation of formwork for pouring aggregate stairs with the stringers, brackets and spacers being reuseable.

4 Claims, 23 Drawing Sheets

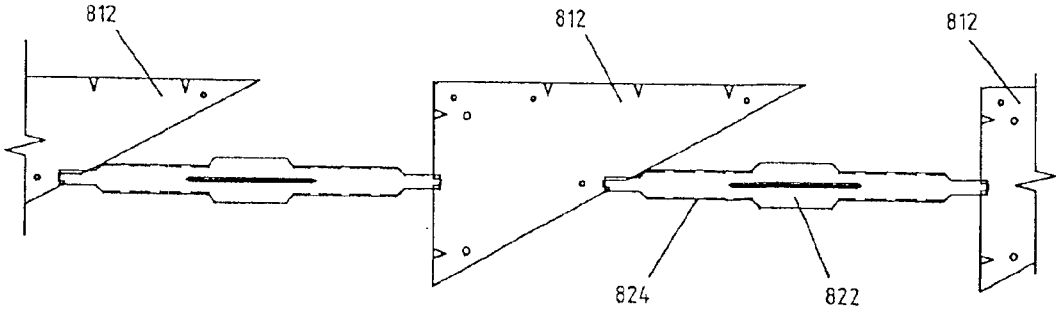
FIG 30
FIG 31
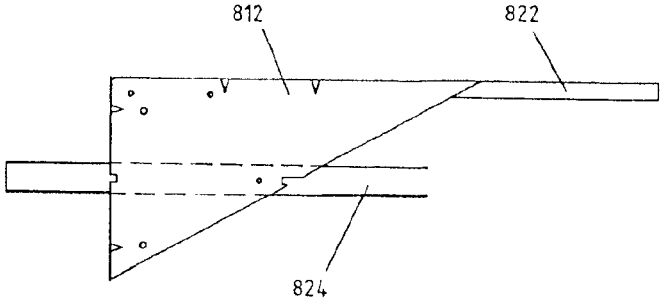
FIG 32
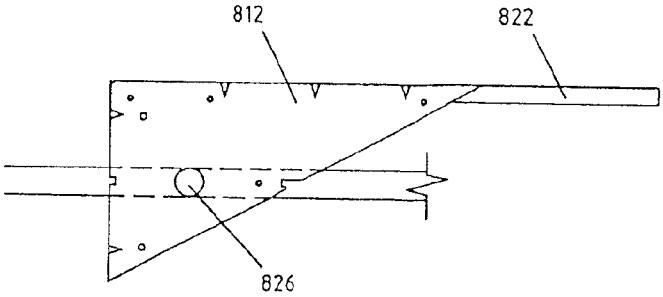
FIG 33
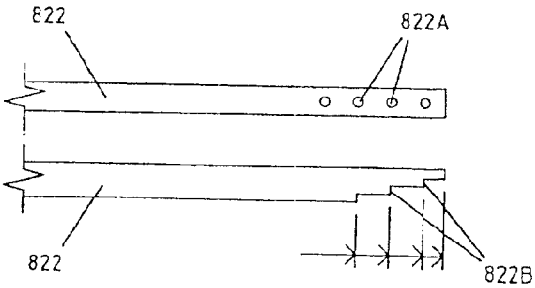

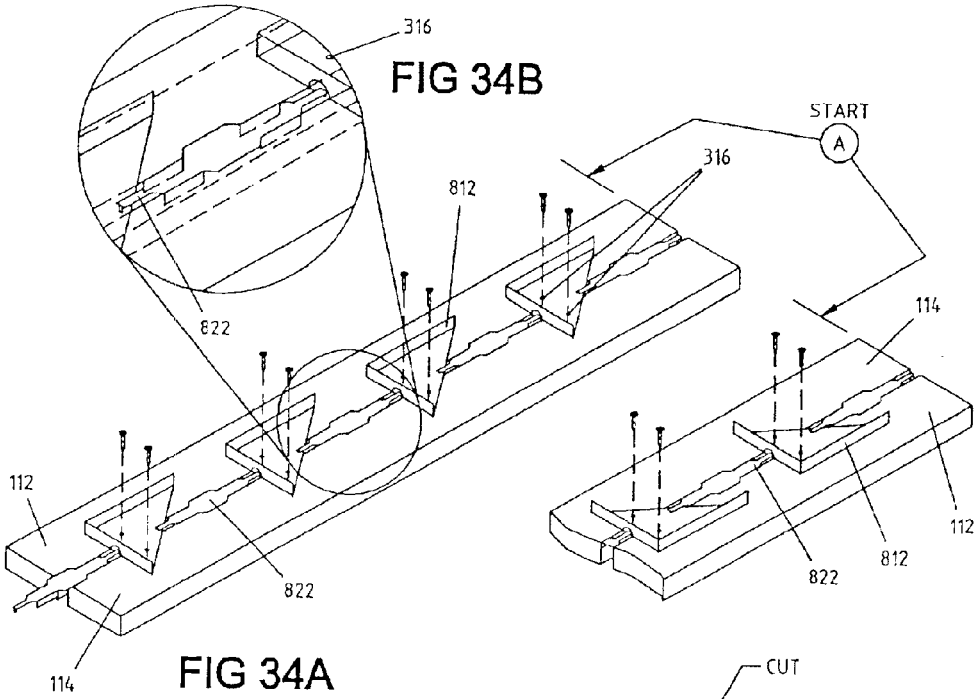
FIG 34A
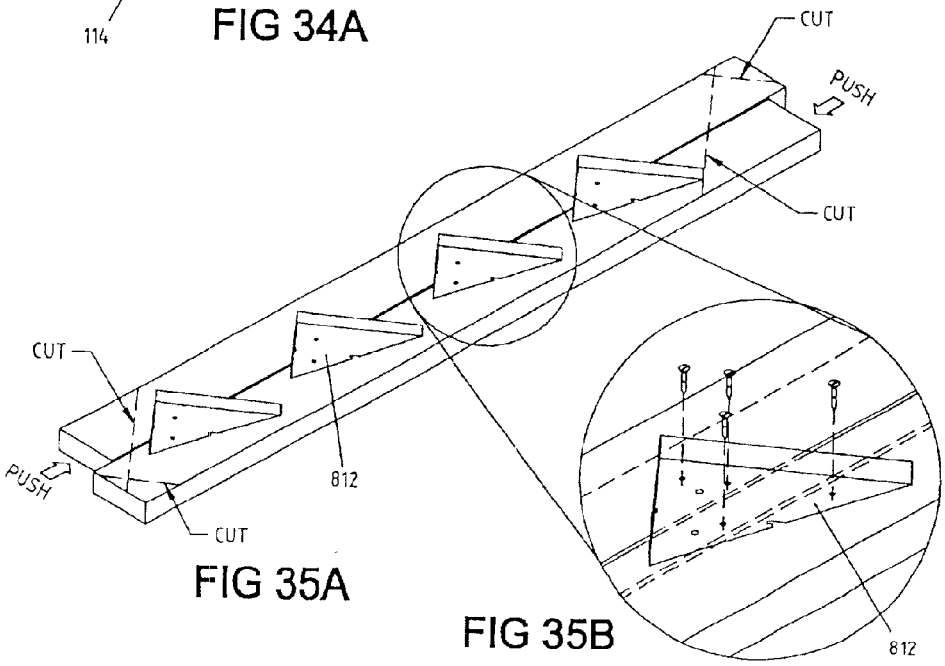
FIG 35A
FIG 35B 814
822
118
812
112
114
riser height
Rotate
PUSH
tread width
390
392

ADJUSTABLE STAIR STRINGER AND RAILING

This application is a Continuation-In-Part of application Ser. No. 09/315,809, filed May 21, 1999 now U.S. Pat. No. 6,354,403. That application claims priority from Provisioal Application No. 60/085,151 for ADJUSTABLE STAIR STRINGER AND RAILING filed May 21, 1998 by Richard Truckner and Paul Truckner.

Nunerous innovations for adjustable stairways have been provided in the prior art that are described as follows. Even though these innovations may be suitable for specific individual purposes to which they address, they differ from the present invention as hereinafter contrasted.

The prior art does not utilize a pivoted motion and does not allow an infinite amount of variable spacings when framing stairs and/or a railing. The present invention allows an infinite amount of variable spacings and use of a pivoting motion.

U.S. Pat. No. 2,245,825 to W. E. Ross teaches a folding stand that has pivoting support but is not based on vertical holes which keep treads in a horizontal position with an infinite amount of variable spacings. Furthermore, the patented invention utilizes different elements from the present invention. Some of the differences are:

1) Vertical holes are not important,
2) Stair is adjustable into one position only,
3) Not meant to be permanently fixed after moved into position on risers,
4) Risers and treads to not slide past each other,
5) Pivoting tread support is not fixed in position after adjustment and therefore not used to lock stringers.

U.S. Pat. No. 4,370,664 to J. J. Whitehead teaches an adjustable staircase. The patented invention does not have any pivoting motion and utilizes different elements from the present invention.

U.S. Pat. No. 3,885,365 to J. W. Cox teaches a self adjusting stair which utilizes a truss assemblage. In the patented invention adjustments are made using a pin and slot. The patented invention does not utilize any pivoting motion and the rails are not adjusted by stringers as with the present invention.

U.S. Pat. No. 3,962,838 to J. W. Cox teaches a self adjusting stair which utilizes spacers in a truss assemblage. The patented invention does not utilize a pivoting motion and the rails are not adjusted by stringers.

U.S. Pat. No. 4,406,347 to N. M. Strathopoulos teaches a modular staircase assembly. The patented invention does not utilize a pivoting motion. The rails are not adjusted by stringers and are not adjusted on vertical holes.

U.S. Pat. No. 4,959,935 to H. R. Stob teaches a prefabricated adjustable stairway. The patented invention does not utilize a pivoting motion and the rails are not adjusted by stringers. This apparatus uses a three point pivoting action so that stringers do not separate during adjustment and slide one on top of the other.

U.S. Pat. No. 5,189,854 to K. J. Nebel teaches an adjustable height staircase. The patented invention does not utilize a pivoting apparatus as described herein. The present invention utilizes a pivoting apparatus and contains different elements from the patented invention for at least the following reasons:

1) Treds are directly connected to stringers,
2) No risers,
3) No sliding motion of riser past the tread.

U.S. Pat. No. 4,124,957 to Pouplaw shows treads that are directly connected to stringers, stringers that have special tongue and groove spacers which must be an exact size each time in order to lock stringers otherwise the stringers must be secured top and botton of the stair only, and risers and treads do not slide past each other.

Numerous innovations for adjustable staircases have been provided in the prior art that are adapted to be used. Even though these innovations may be suitable for specific individual purposes to which they address, they would not be suitable for the purposes of the present invention as heretofore described.

SUMMARY OF THE INVENTION

The structure of the present invention can be used for forming a stair and may also be used as a support for concrete form work, as a form for a ramp, as a form for adjustable shelves, as an adjustable bleacher, and for adjustable displays.

It is an object of the present invention to provide an adjustable stringer and railing that allows users to have a quickly formed stair structure.

It is another object of the present invention to provide an adjustable stringer and railing that provides partially assembled elements that can be adjusted to a variety of applications and then securely fixed to form a stair framing and/or railing framing.

It is another object of the present invention to provide an adjustable stringer and railing that utilizes a pivoting motion.

It is another object of the present invention to provide an adjustable stringer and railing that allows an infinite amount of variable spacings when creating stairs and/or railing.

It is another object of the present invention to provide an adjustable stringer and railing that eliminates the need to calculate spacing between step treads and angle of the stairs.

It is another object of the present invention to provide an adjustable stringer and railing that provides an embodiment that includes an upper stringer arm, a lower stringer arm and at least one riser support.

It is another object of the present invention to provide an adjustable stringer and railing that provides an embodiment that includes an upper rail support and at least two railing posts pivotally attached to the upper rail support.

It is another object of the present invention to provide an adjustable stringer and railing that is easy and inexpensive to manufacture.

Another object of the present invention is the use of a bracket and setting and spacer bar that can be used with stringer elements for simplifying the formation of a stair assembly with treads. risers and rail supports.

Further objects of the present invention include a stair forming apparatus that includes a pivoting block to which treads and risers can be attached, a pivoting block to which treads only can be attached, a pivoting block which allows risers and treads to slide past each other, a pivoting block which allows risers and treads to be attached such that the risers and treads can be attached to each other after assembly to form a solid construction in which the risers become beams and the treads become lateral bracing to produce great structural stength and much wider stair widths than normal with on center supports (additional stringers) as with normal stairs, and greater stringer strength than with normal saw tooth stringers because of greater stringer depth and, when the riser/tread supports are secured to the upper and lower stringers after adjustment, the stringers are bonded together to form one solid stringer which also is capable of much greater spans without additional supports.

The structure of the present invention includes riser and tread support which allows risers and tread to slide past each other (as the stinger is adjusted) in order to utilize standard lumber and eliminate the need to cut lumber to exact widths, to use standard lumber of varing lengths according to width of the stair (i.e. 4' to 10' wide stairs), to use riser and tread support systems which, after pivoting and adjusting in position, allows risers to be used as beams which greatly increases the strucutural strength of the stair allowing much greater stair widths than normal without the need for additional center support stringers, and provides a stringer system which, when the riser/tread supports are secured, the stringer members are bonded together to form a much stronger stringer member than in normal "saw tooth" type construction giving much greater stair lengths without additional supports.

The foregoing benefits are accomplished with the use of a simplified bracket, spacer and setting combination that permits the assembly of a stair stringer assembly without difficulty permitting the "do it your-selfer" to install a stair assembly with simple instructions.

BRIEF DESCRIPTION OF THE DRAWINGS

FIGS. 30, 31 and 32 are alternative forms of bracket elements with setting/spacing bars.

FIG. 33 is a view showing alternative adjustable spacing constructing.

FIGS. 34A, 34B, 35A, 35B, 36A and 36B illustrate the use of the brackets, setting/spacer bars and stringer elements of the present invention.

DETAILED DESCRIPTION OF EMBODIMENTS

Figure 1:
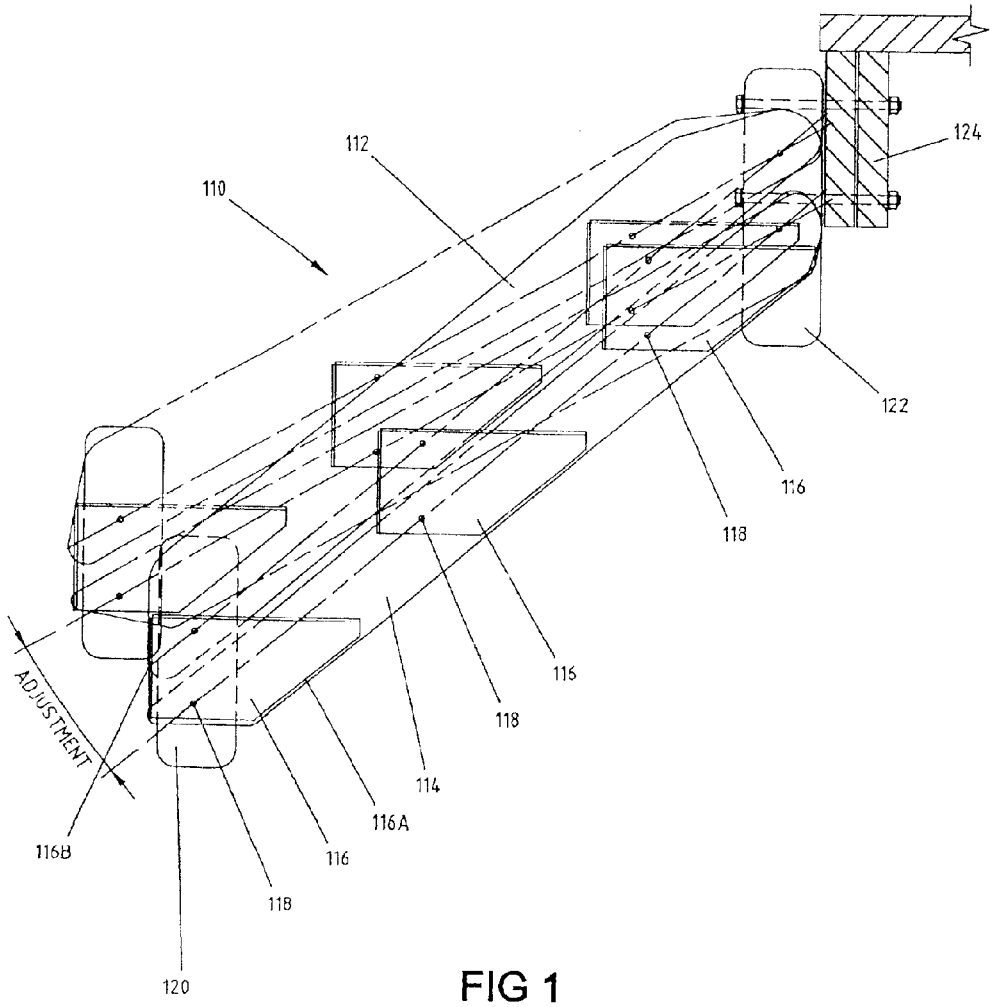
FIG. 1 is a side view of the stair embodiment of the adjustable stair stinger and railing illustrating two possible inclinations.

Referring to FIG. 1 which is a side view of the stair embodiment of an adjustable stair stringer and railing 110 which includes an upper stringer arm 112, a lower stringer arm 114 and at least one riser/tread support 116. The upper stringer arm 112 is parallel to the lower stringer arm 114. The riser/tread support 116 is pivotally attached to the upper stringer arm 112 and pivotally attached to the lower stringer arm 114. The riser/tread support 116 may be attached to the upper stringer arm 112 and lower stringer arm 114 by riser/tread stringer arm fasteners 118. The riser/tread stringer arm fastener 118 can be a pin, screw, bolt, clamp, dowel or hook.

The riser/tread support 116 can be in the shape of a rectangle, square, triangle, pentangle or circle. The riser/tread support 116 may be rectangular in shape and contain a riser/tread support beveled corner 116A. Furthermore, if there are more than one riser/tread supports 116 the riser/tread supports 116 can be positioned equally along the upper stringer arm 112 and lower stringer arm 114. The riser/tread support 116 can be attached at horizontally positioned fixed points 116B fastened to the upper stringer arm 112 and lower stringer arm 114.

The stair embodiment of the adjustable stair stringer and railing 110 can include a lower stringer support 120 which can be attachable to the upper stringer arm 112 and the lower stringer arm 114, and an upper stringer support 122 which can be attachable to the upper stringer arm 112 and the lower stringer arm 114.

The stair embodiment of the adjustable stair stringer and railing 110 can be manufactured from wood, fiberglass, metal, metal alloys, epoxy, carbon graphite, concrete or plastic. It further can be adapted for use to pour concrete and create concrete stairs.

Figure 2:
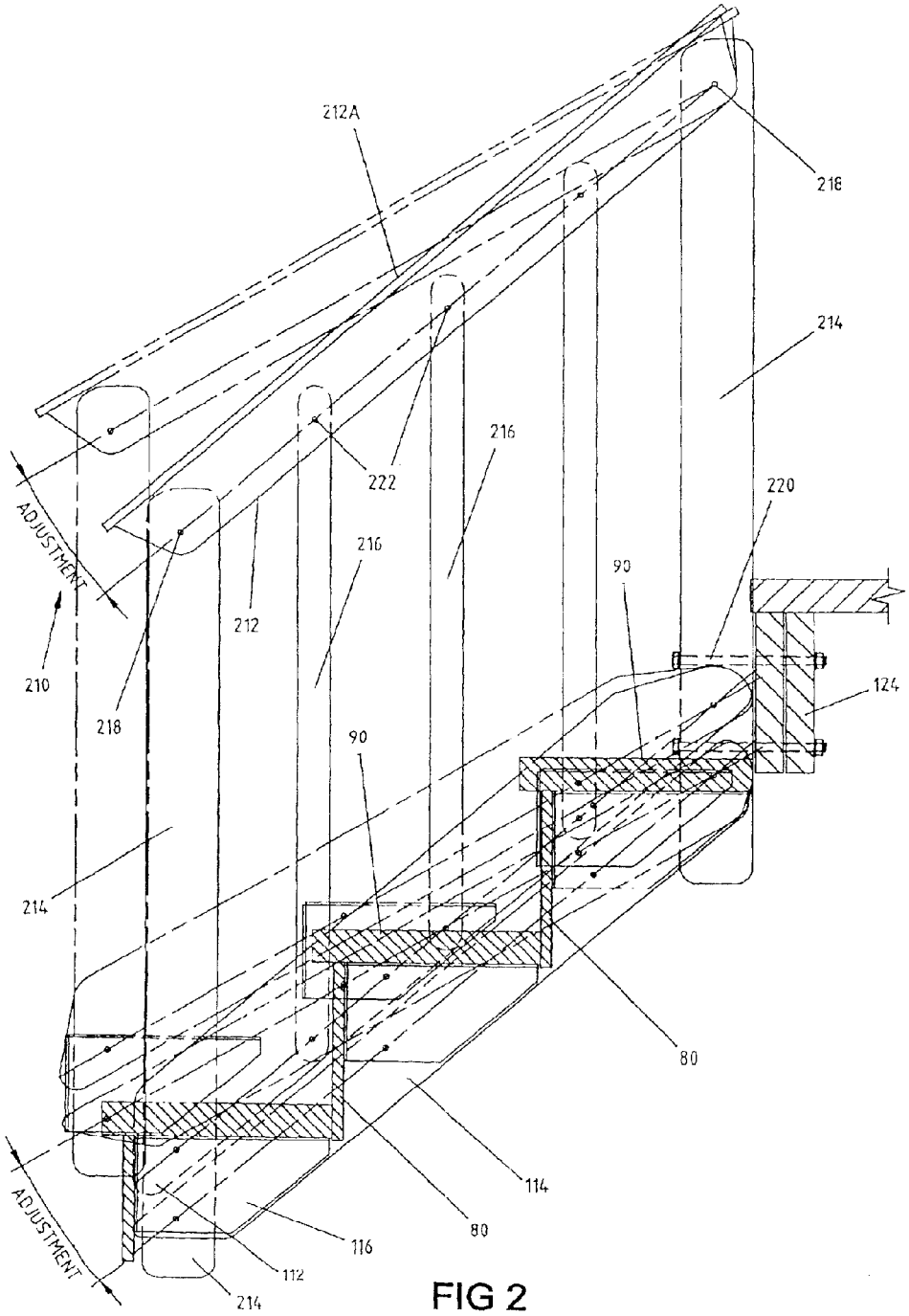
FIG. 2 is a side view of the railing embodiment of the adjustable stair stringer and railing.
Figure 3:
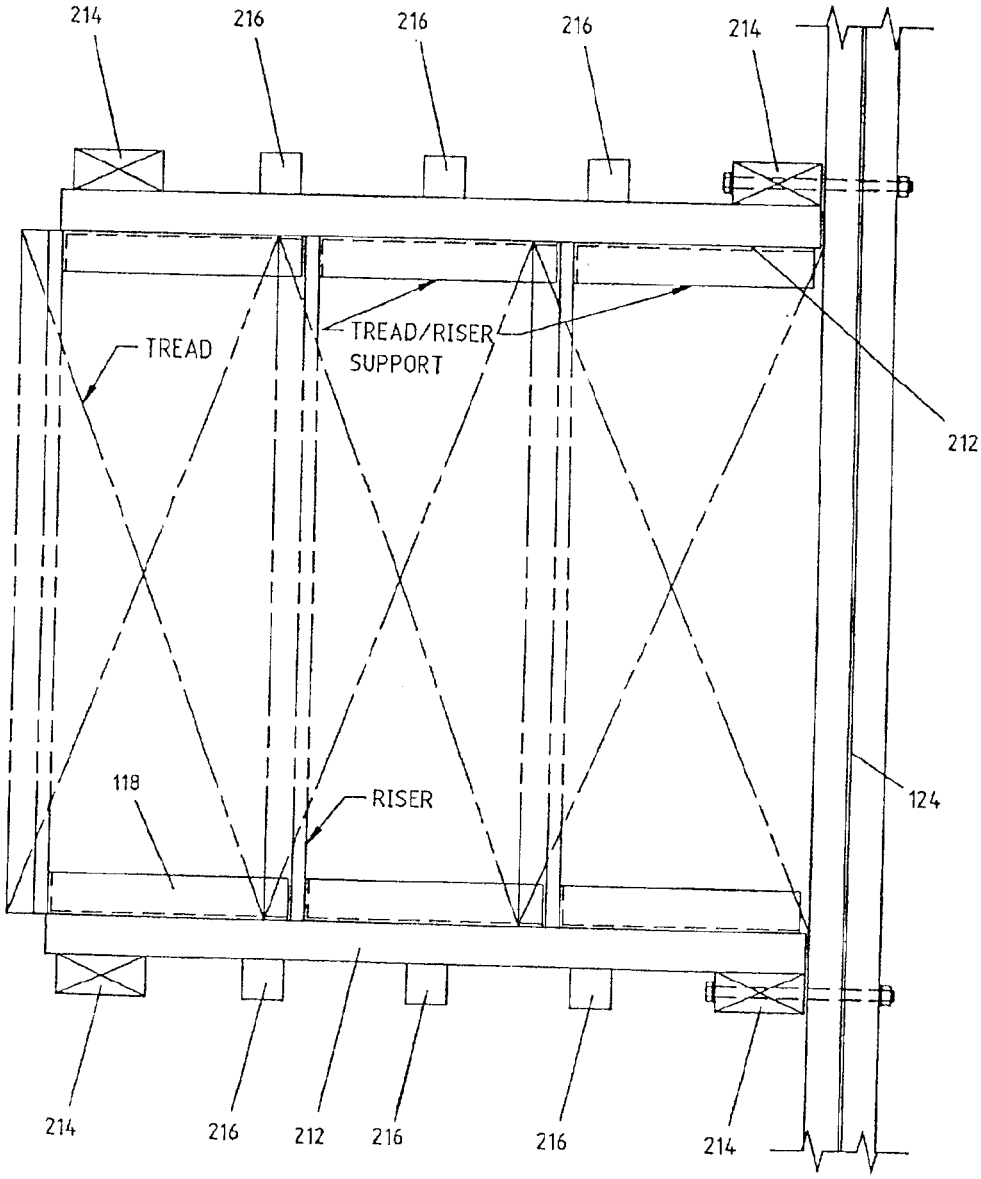
FIG. 3 is a top view of the adjustable stair stringer and railing.
Figure 4:
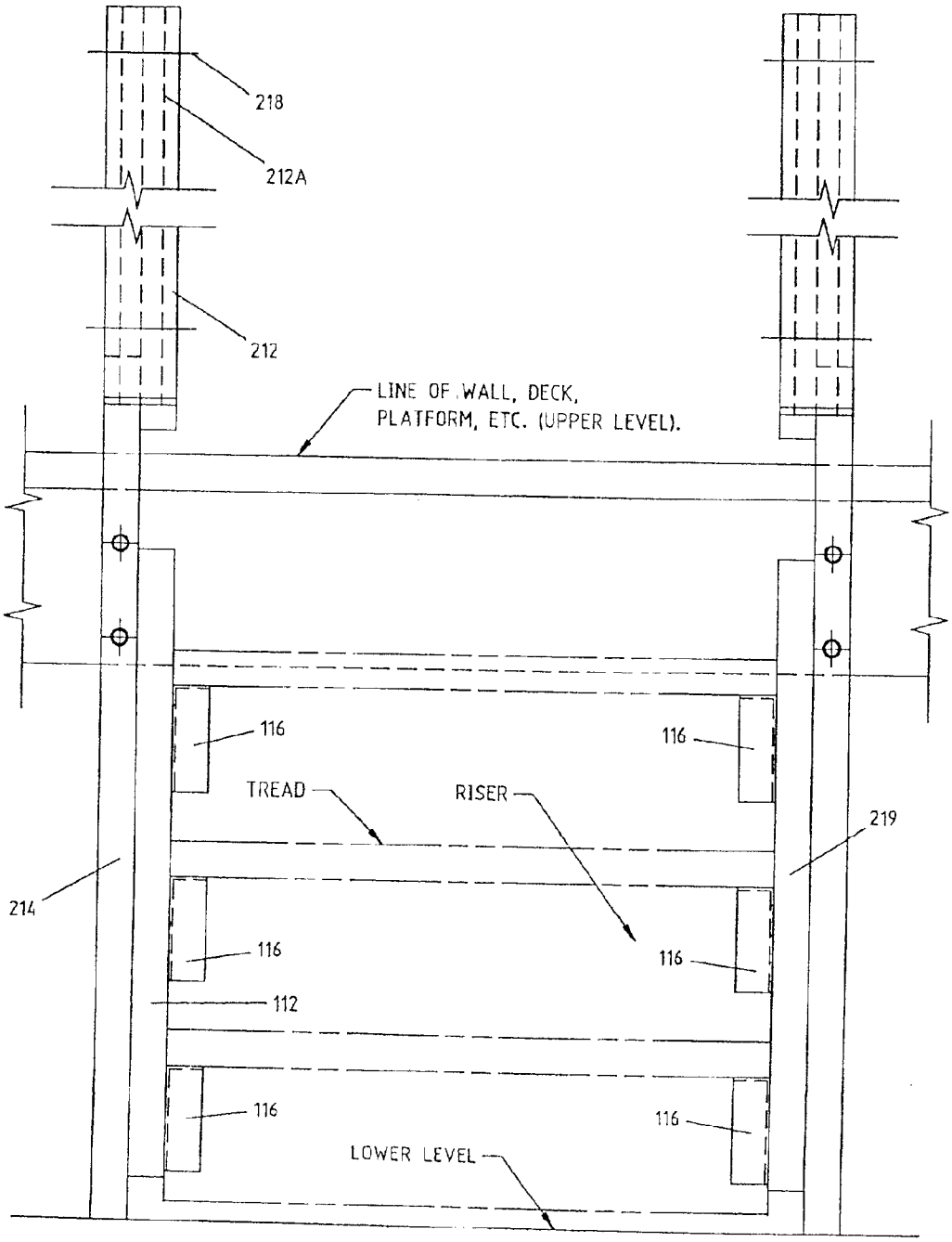
FIG. 4 is a front view showing the assembled stair and railing set in position.

The railing embodiment of the adjustable stair stringer and railing 210 as shown in FIG. 2 showing risers 80 and treads 90 contains an upper rail support 212 and at least two railing posts 214. The two railing posts 214 are pivotally attached to the upper rail support 212. The at least two railing posts 214 are pivotally attached to the upper rail support 212 by upper rail support railing posts fasteners 218. The upper rail support railing post fastener 218 can be a pin, screw, bolt, clamp, dowel or a hook.

The railing embodiment of the adjustable stair stringer and railing 210 can contain at least one ballister 216 pivotally attachable and/or attached to the upper rail support 212. The at least one ballister 216 is parallel to the railing posts 214. The ballister 216 can be attached to the upper rail support 212 by an upper rail support ballister fastener 222. The at least one ballister 216 can be positioned equally along the upper rail support 212. The upper rail support ballister fastener 222 can be a pin, screw, bolt, clamp, dowel or hook.

The rail embodiment of the adjustable stair stringer and railing 210 can contain an upper rail support railing cap 212A which is attached to the upper rail support 212. It can further contain a railing post attachment 220 attachable to each of the railing posts 214.

It will be understood that each of the elements describe above, or two or more together, may also find useful application in other types of constructions differing from the type described above.

Figure 6:
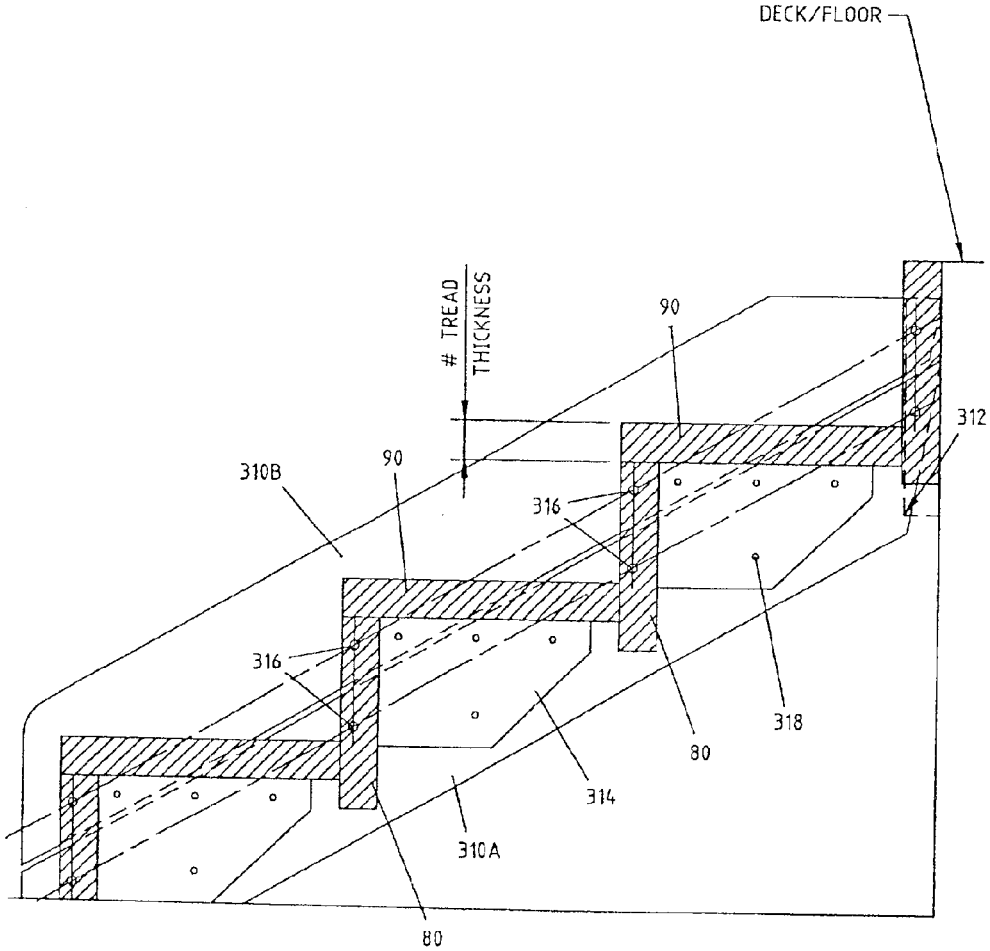
FIG. 6 is a side view of an alternative form of the adjustable stair as assembled.
Figure 7:
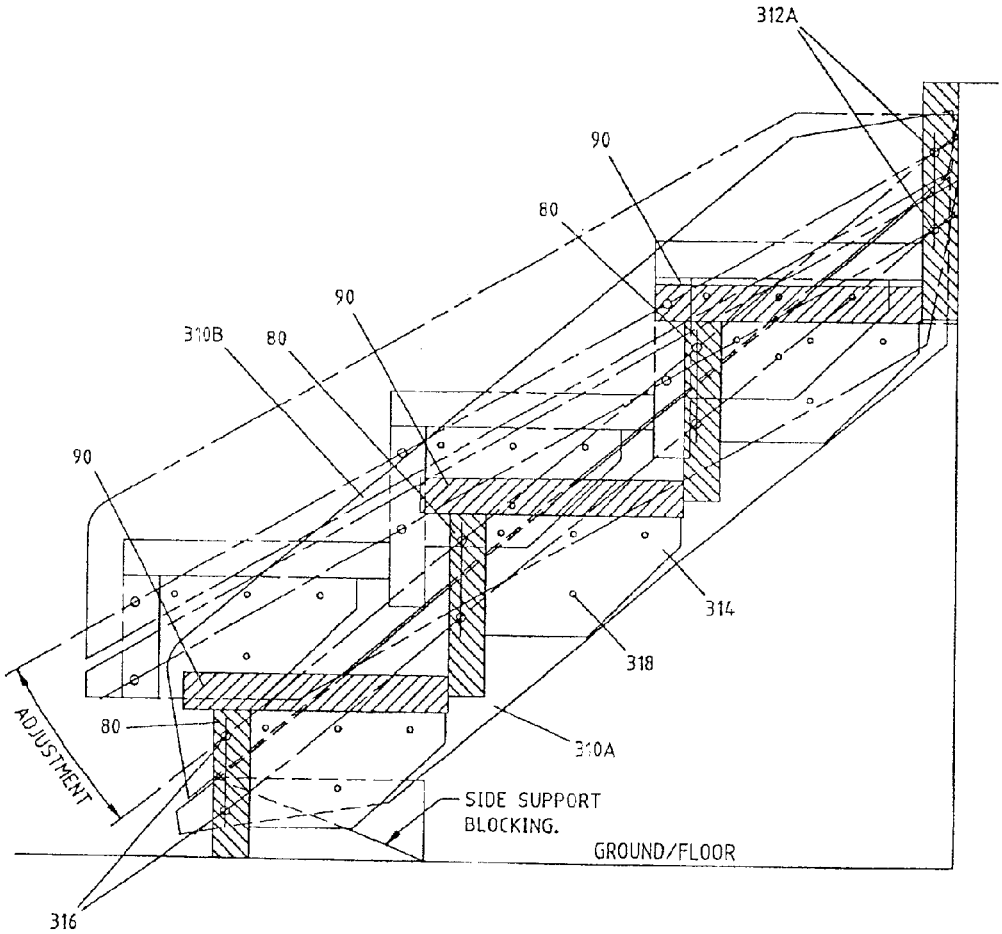
FIG. 7 is a side view showing the adjustable stair in two alternative rise angles using the same elements.
Figure 8:
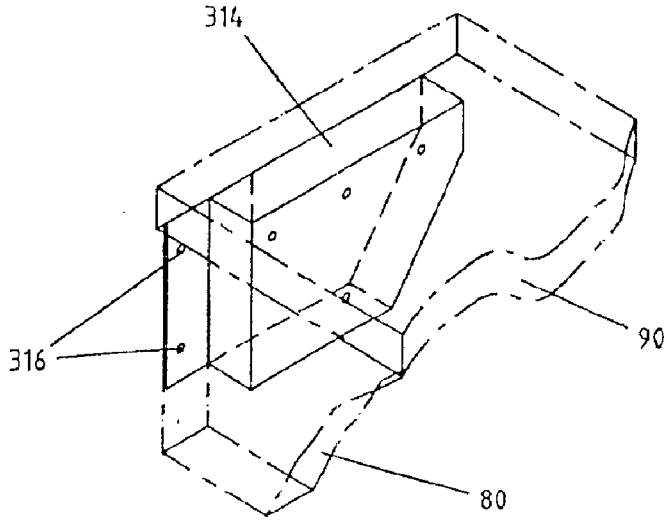
FIG. 8 is a perspective view showing the nailing block and pivot attachment plate for the stair assembly of FIG. 7.
Figure 9:
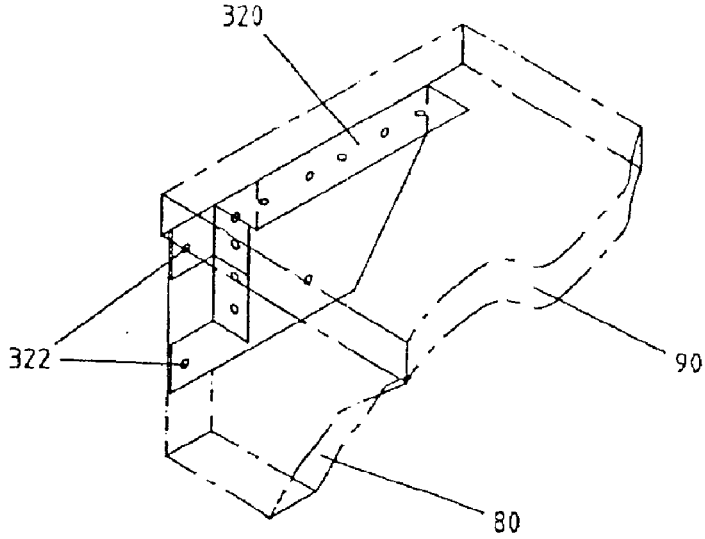
FIG. 9 is a perspective view of an alternative riser tread support.
Figure 10:
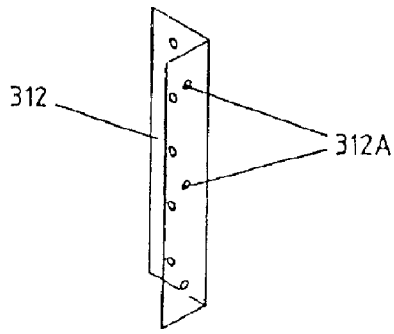
FIG. 10 is a perspective view of the attachment bracket as used in the present invention.
Figure 11:
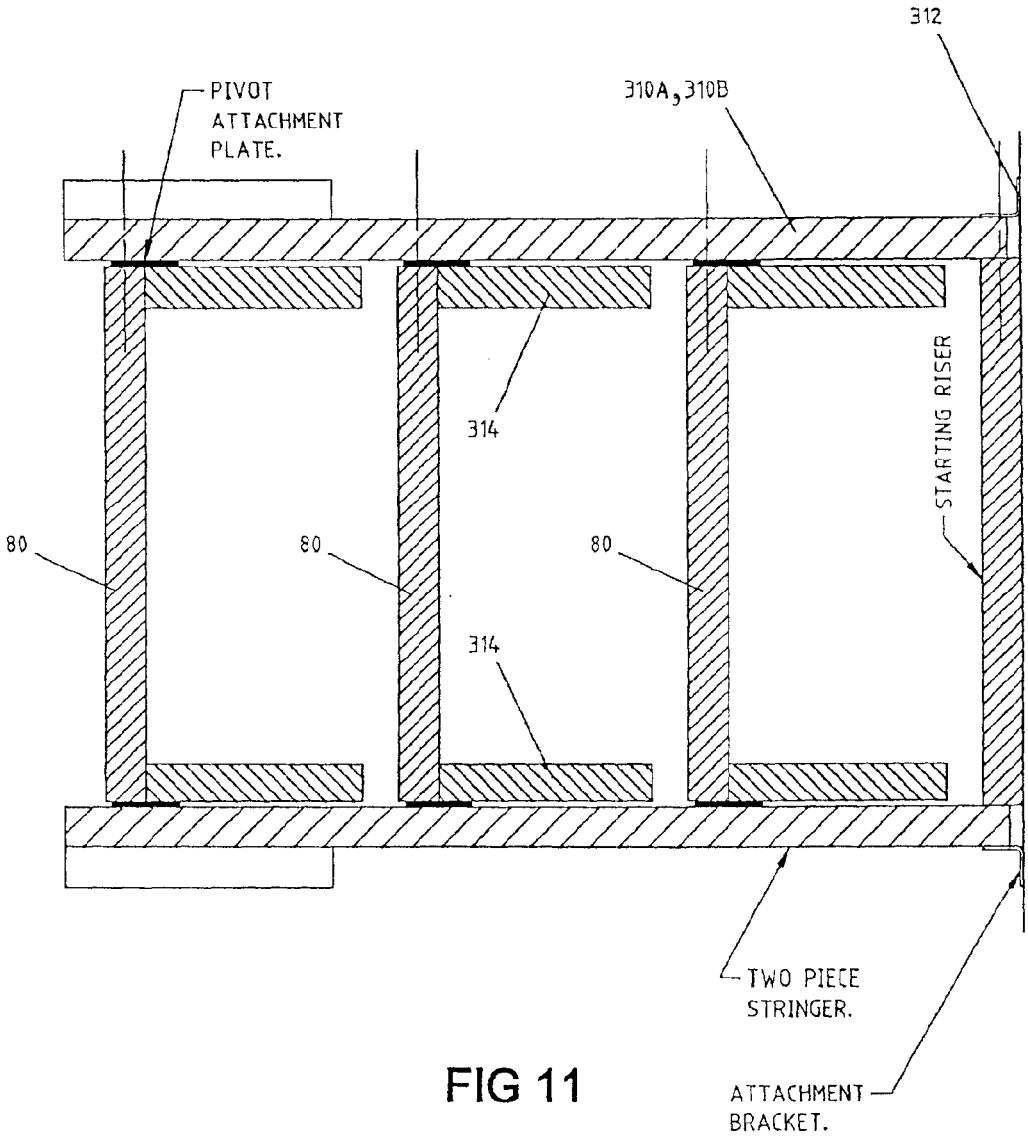
FIG. 11 is a top plan view of a stair assembly of the form of FIG. 7 with risers and without the treads.

FIGS. 6–10 illustrate an alternative form of the stringer, riser and tread assembly in accord with the present invention. In this form a two piece stringer 310A (lower) and 310B (upper), as shown in FIGS. 6 & 7, is first attached to a deck or wall vertical surface by an attachment bracket 312, as shown in FIG. 10, with the two pieces of the stringer attached to pivot holes 312A in the bracket. Riser/tread supports 314 having pivot holes 316 spaced the same distances as the pivot holes in the attachment bracket are spaced along the risers and are fixed to the risers by suitable means at screw holes 318 to cause the riser/tread supports to be parallel to the attachment bracket and equally spaced along the risers. These vertical pivot riser/tread support 314 are unique because the supports pivot for adjustment only and are fixed in position after adjustment; the fixing of the riser/tread supports joins the two pieces of the stinger to form a one piece, permanently adjusted stringer which is structurally superior to normal stair construction; the positioning of the pivot points (opposite risers) allows the top of the stair to be attached the same distance down from the deck/floor level each time regardless of the riser height because all risers adjust equally including the first riser; the configuration of the riser/tread support allows risers 80 and treads 90 to slide against each other for adjustment; and when the risers are attached to the riser/tread supports and the treads, each riser then acts as a beam giving the stair much greater structural stability and allowing greater widths for a stair without additional supports. The riser/tread supports 314 can be constructed from metal, composites and other materials. It should be evident that the riser/tread supports 314 are now vertical if the surface of the deck where attachment was made was vertical when the attachment bracket was attached, and as illustrated in the two positions shown in FIG. 7, the riser/tread supports are now in position to be permanently attached to the stringers at securing holes 318 and to have risers 80 and treads 90 attached to the supports.

Figure 12:
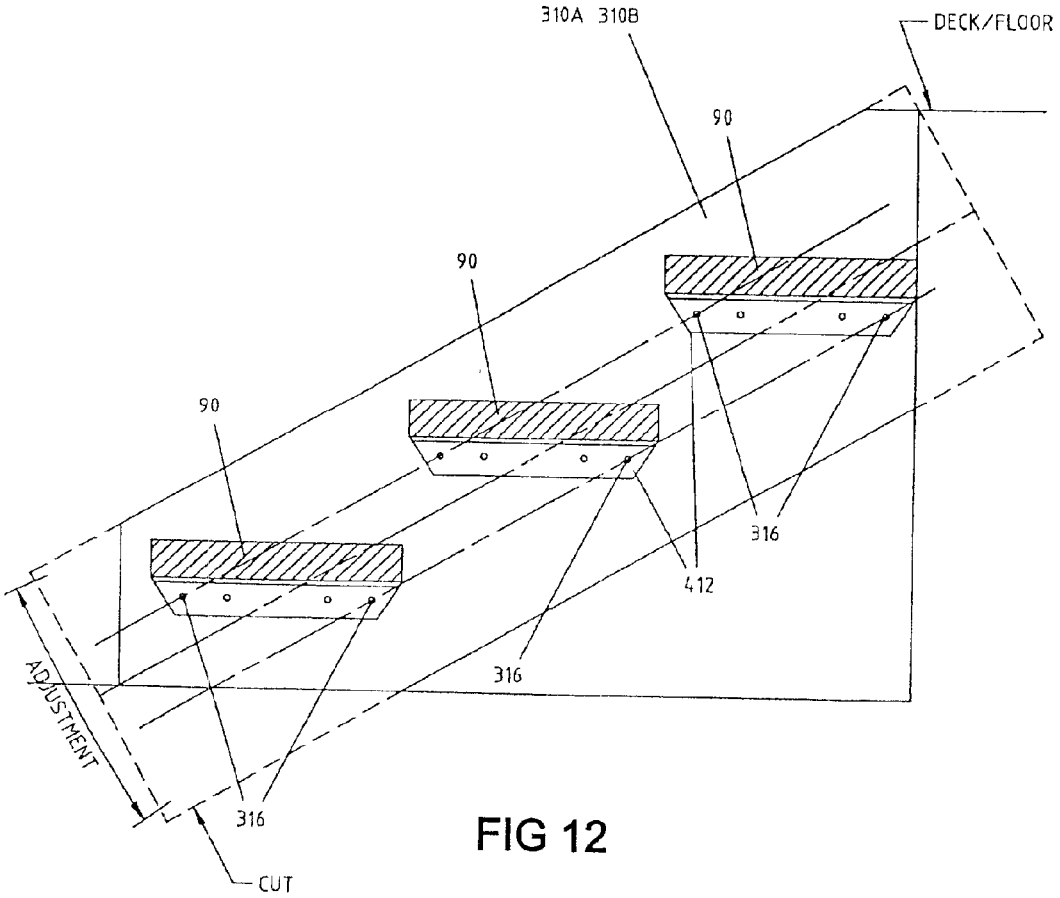
FIG. 12 is a sectional view of a stair assembly of the form of FIG. 7 with the use of horizontal pivots.
Figure 13:
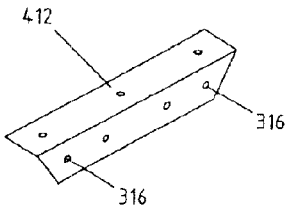
FIG. 13 is a perspective view of the tread support bracket as used in FIG. 12.
Figure 14:
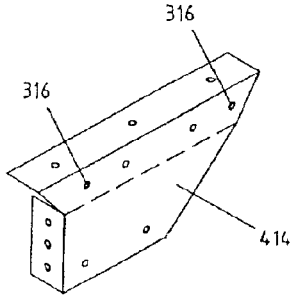
FIG. 14 is an alternative form of a tread support and riser support using horizontal pivots as used in FIG. 12.

FIGS. 12–14 illustrate an alternative form of the stringer, riser and tread assembly formed using horizontal pivoted tread support brackets and including an alternative tread support with riser support elements. FIG. 13 shows alternative pivoting tread supports using a straight bracket 412 and FIG. 14 another support 414, which is truncated in shape which can be used with or without a riser, but allowing greater fixing to the stringer. Riser 80 and treads 90 can still slide past each other to form beams. There are three steps shown on the drawing which illustrates how this system would be installed with pivot points that are horizontal.

The feature of the riser/tread support in either the vertical or horizontal pivoted form is that it is a one piece apparatus which attaches to the two piece stringer using two pivot points which normally are vertical or horizontal but can be at any common angle. The riser/tread supports pivots to adjust for a required height to form the correct stair profile.

The riser/tread support is then fixed in position (using nails, screws, bolts, glue, etc.) against the two piece stringer to form one solid, non-moving stringer which is capable of supporting both risers and treads or treads alone or risers alone (when being used for concrete formwork). The two piece stringer is then cut (at the dotted lines shown) to conform to the deck or wall at the top and the base at ground level at the bottom. The riser/tread support allows risers and treads to slide past each other so that the risers can be adjusted for height sliding up or down past the back of the tread. The back of the tread is pushed against the face of the riser to form an enclosed stair. The position of the risers and treads can vary infinitely in respect to each other depending on the stair adjustment.

Figure 15:
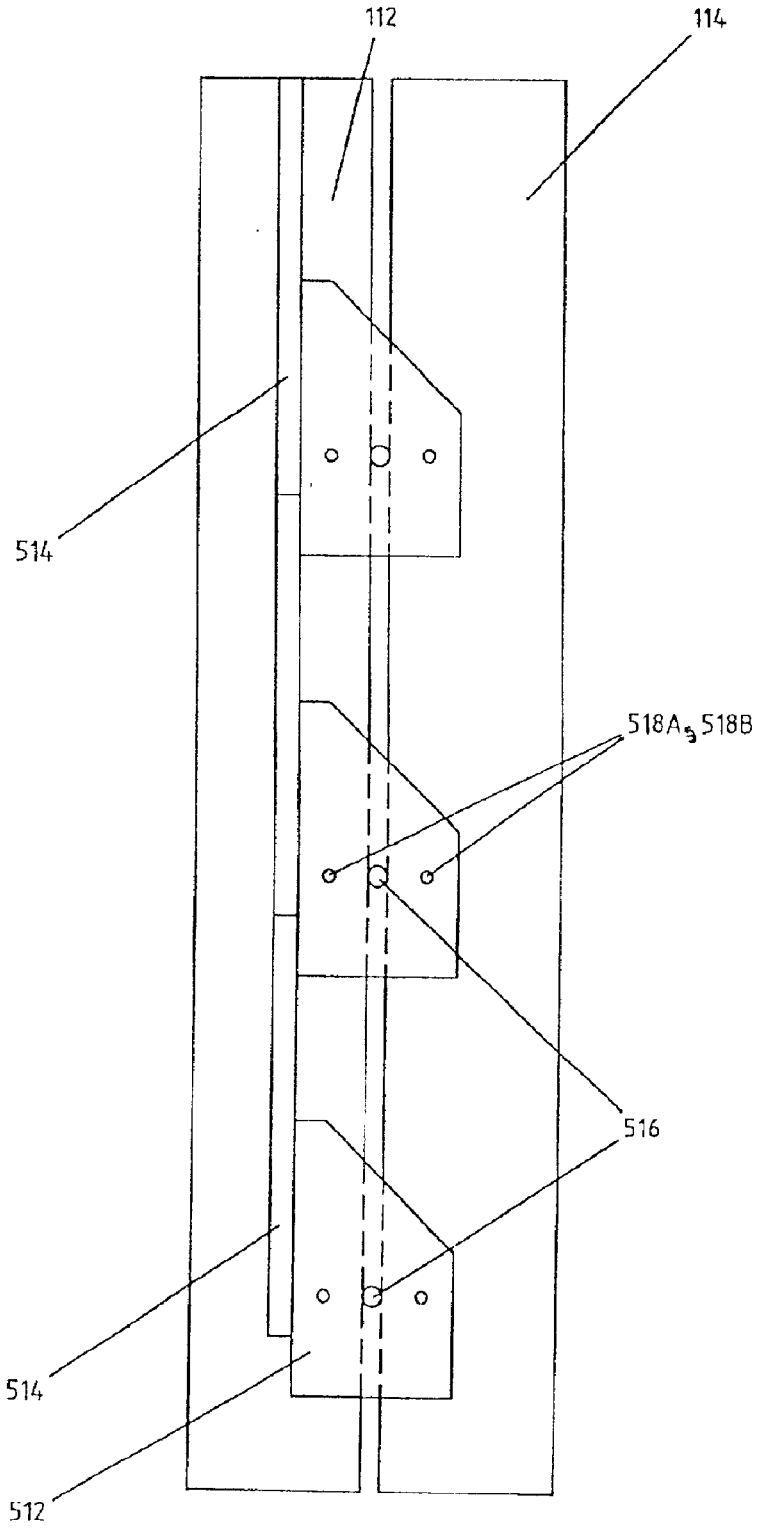
FIG. 15 is an elevation view showing alternative riser/tread supports which are individually set on a two piece stringer.
Figure 17:
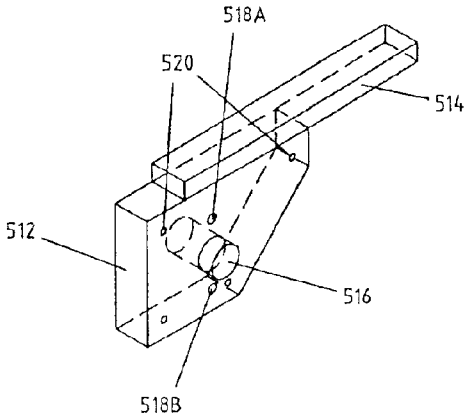
FIG. 17 is a perspective view of the riser/tread support of FIGS. 15 & 16.
Figure 16:
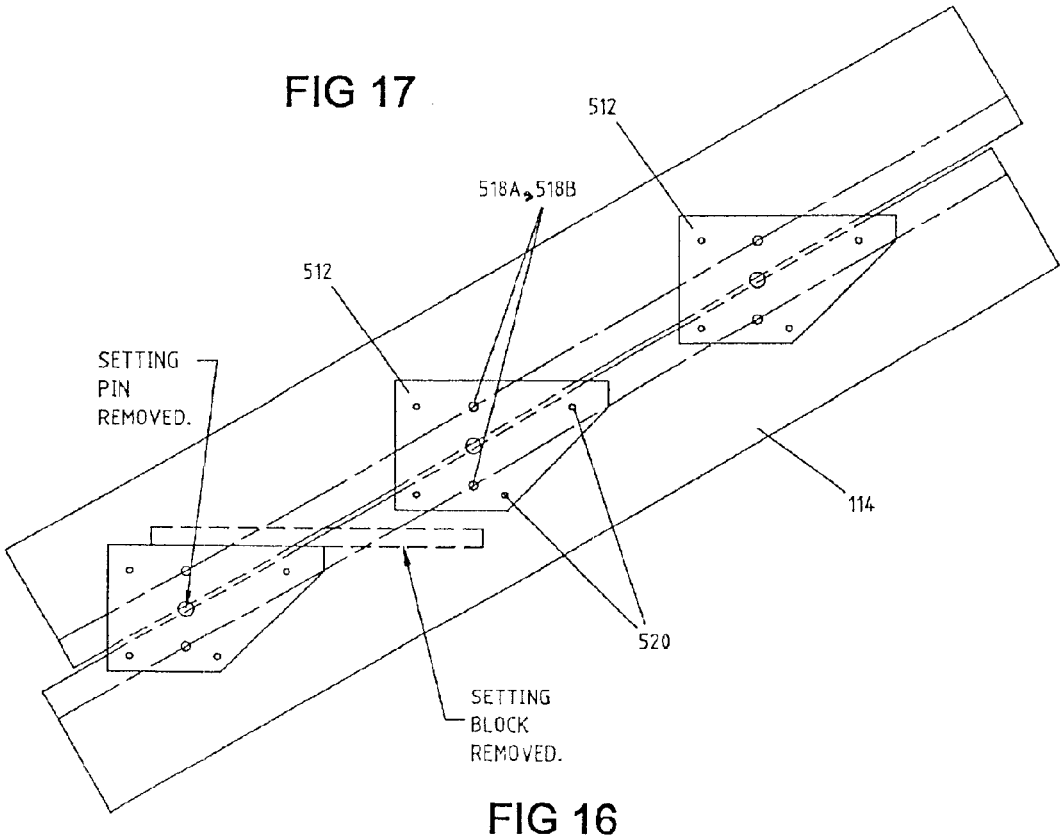
FIG. 16 is an elevation view showing the riser/tread supports adjusted in position.

FIGS. 15–17 illustrate a further alternative form for riser/tread supports 512 which are individually set on a two piece stringer 310A and 310B using removable setting blocks 514 and setting pins 516. In this form the removable setting blocks 514 are used to space the riser/tread supports equally along the two piece stringer by being placed on a reference surface of a support and as their ends abut along the stringer. The stringer pieces are separated from each other by the removable setting pin 516 and the riser/tread supports 512 are attached at their pivot points 518A and 518B to the stringer 112 and to the stringer 114. When the setting blocks 514 and the setting pins 516 are removed, the two parts of the stringer can be slid with respect to each other to adjust the riser/tread supports 512 in the desired vertical position and the riser/tread supports can then be secured to the stringers by screws, nails, or other fasteners at securing holes 520. The riser/tread supports are then in position for the attachment of equally spaced treads and risers.

Figure 18:
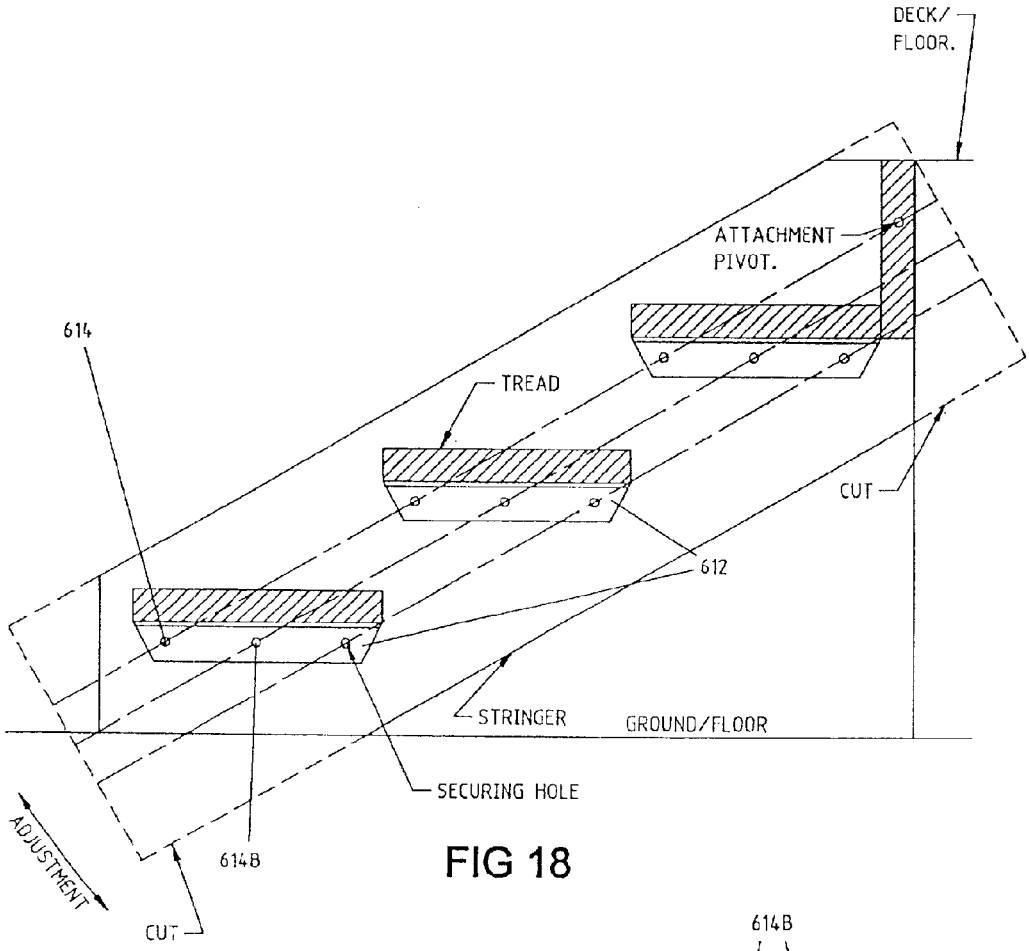
FIG. 18 is an alternative form of the present invention using a single pivot point for a riser/tread support.
Figure 19:
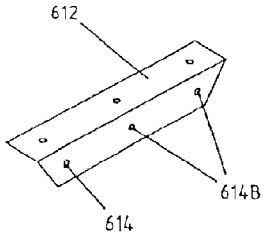
FIGS. 19 & 20 are alternative forms of tread support and riser support for the assembly of FIG. 18.
Figure 20:
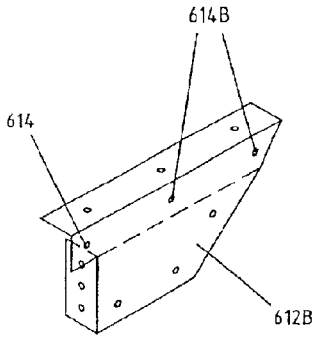
Figure 21:
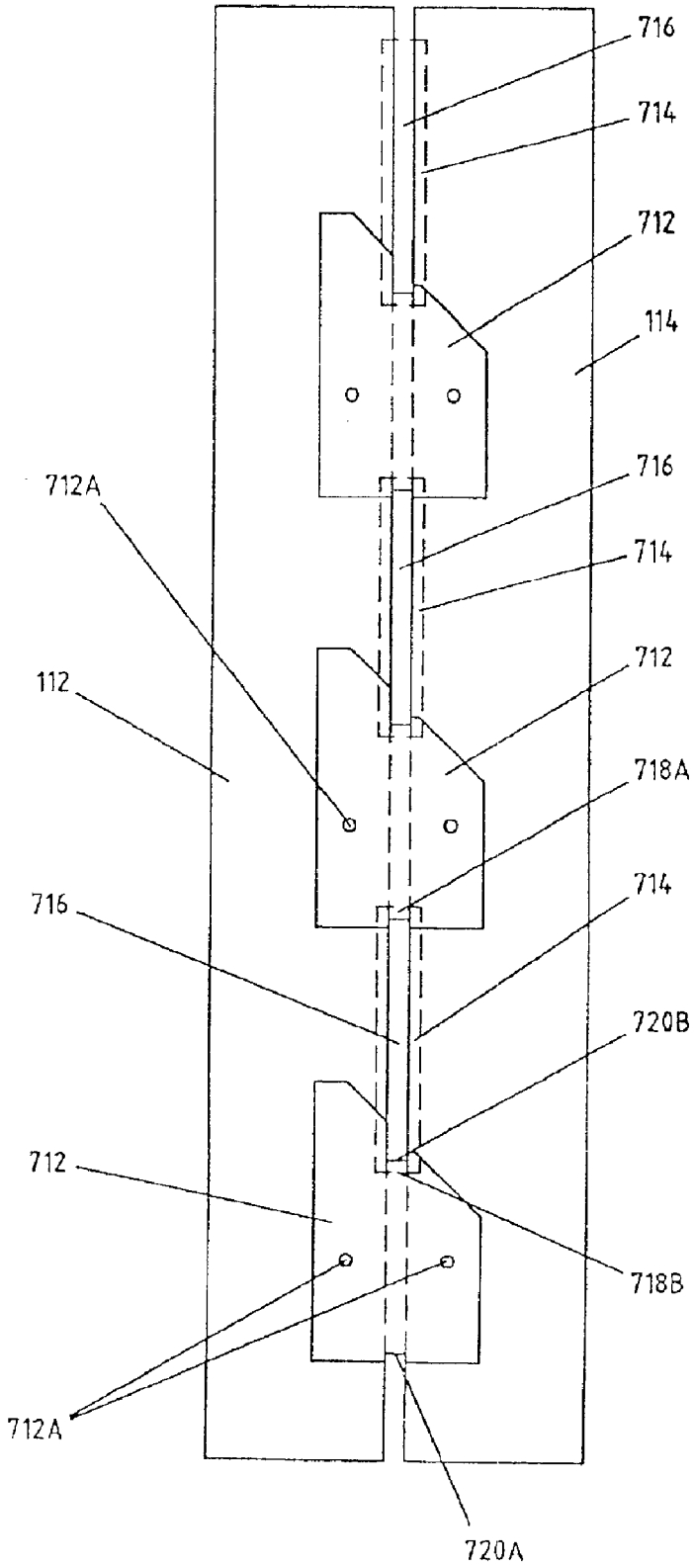
FIG. 21 is a side elevation view with an alternative stair assembly showing riser/tread supports and setting spacing blocks.
Figure 22:
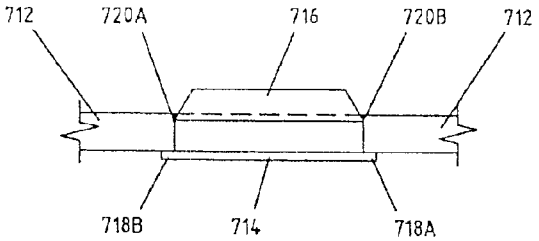
FIG. 22 is a partial top plan view of a portion of FIG. 21.
Figure 25:
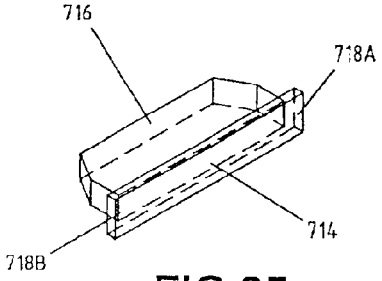
FIGS. 24 and 25 are perspective views of the riser/tread support and setting/spacing block after separation.
Figure 24:
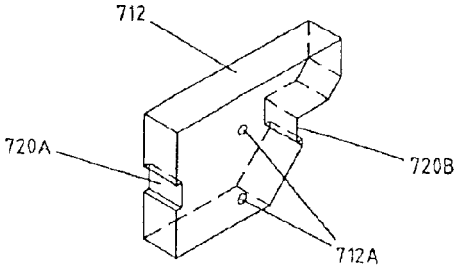
Figure 23:
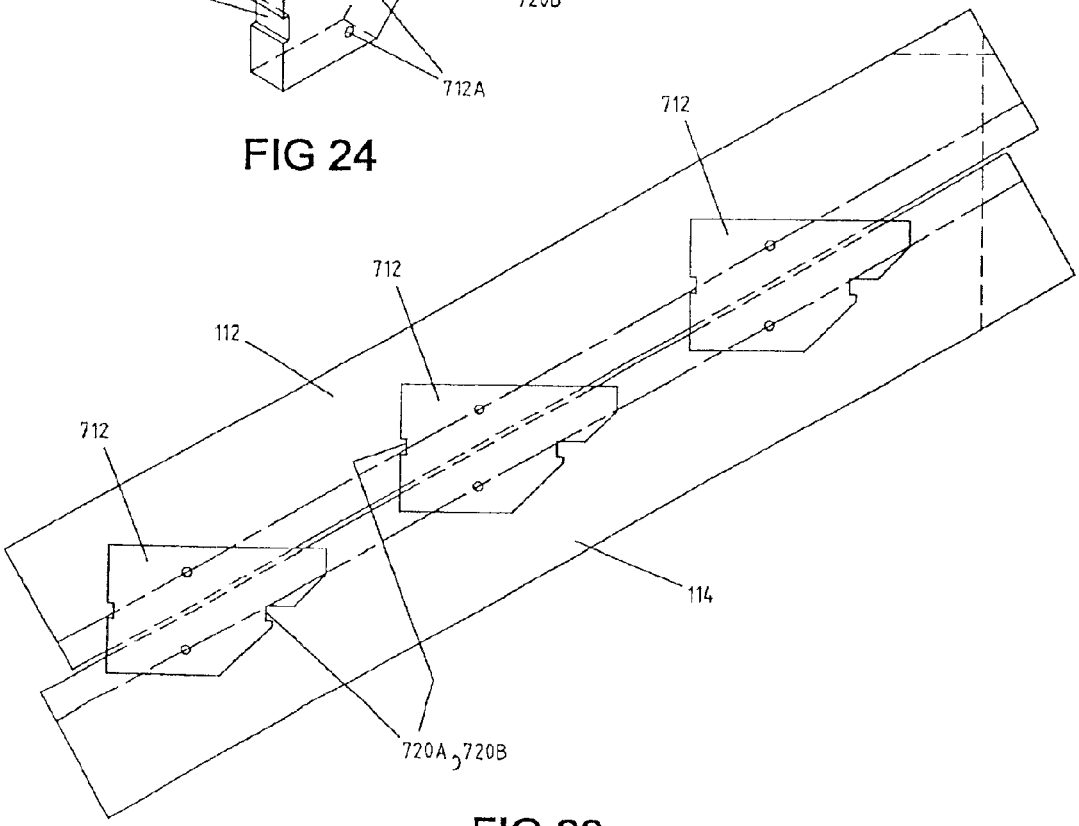
FIG. 23 is a side elevation view of the alternative riser/tread supports of FIG. 21 after removal of the setting/spacing blocks and as set for assembly as a stair riser and tread support.
Figure 26:
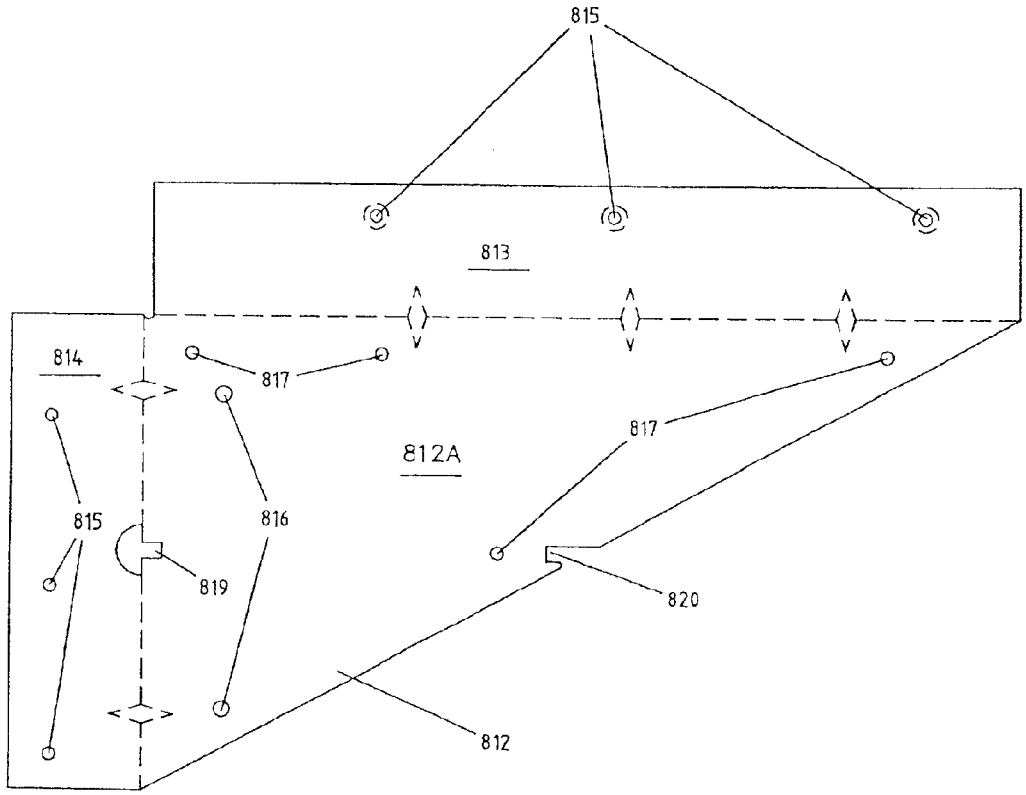
FIG. 26 is a top plan view of a structure from which a bracket may be formed.
Figure 27:
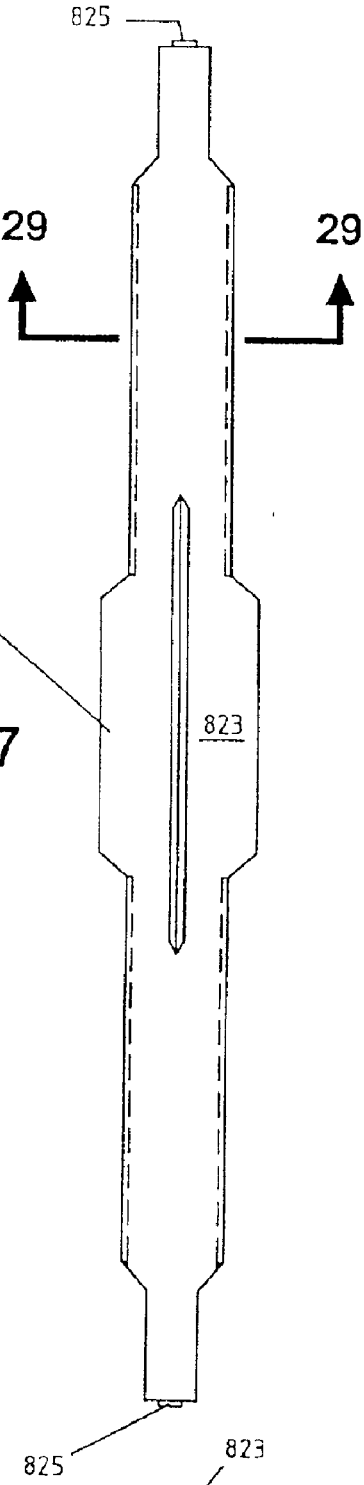
FIG. 27 is a top plan view of a setting and spacer bar for use with the bracket of FIG. 26.
Figure 28:
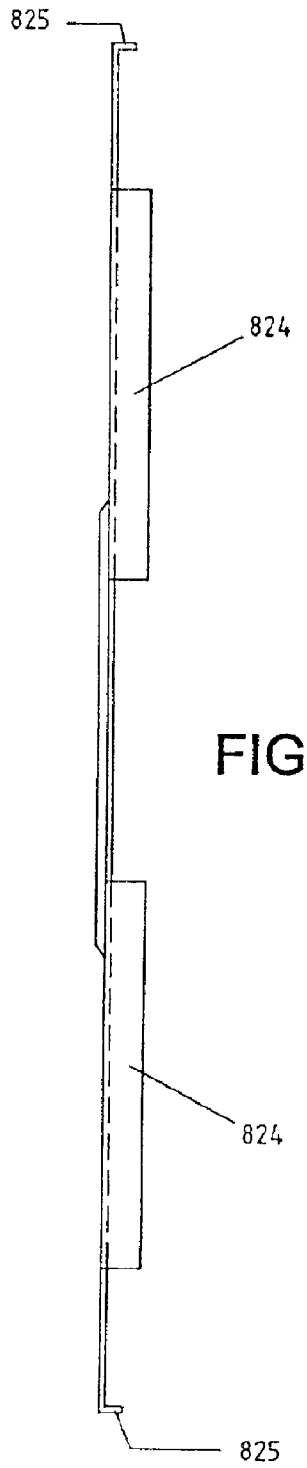
FIG. 28 is a side elevation view of FIG. 27.
Figure 29:
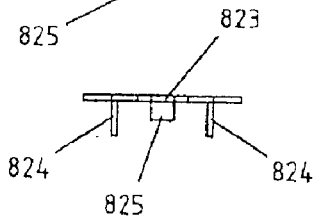
FIG. 29 is a sectional view taken along the lines 29—29 of FIG. 27.

FIGS. 18–20 illustrate a stair section showing pivoting riser/tread riser/tread supports using a single pivot point allowing the tread to be set level after stringer installation. Equally spaced support brackets 612 are pivoted at a single pivot 614 position of the stringer with those pivot positions being located the same distance below the deck/floor when the stringer is attached with the pivot position a desired distance below the level of the deck or floor to which the stair is to be attached. With a single pivot point for each of the equally spaced riser/tread supports, the supports can be attached to the second stringer by suitable means and the treads will always be equally spaced and will have equal rising distances. The single pivot point can be at any common point (shown as alternatives 614B) along the riser/tread support brackets 612 and the brackets can be just a tread support or a tread and riser support. FIG. 20 illustrates an alternative form 612B for the bracket in a truncated form.

FIGS. 21–25 illustrate another alternative form for riser/tread supports for use in the present invention. In this form the riser/tread supports 712 are individually set on a two piece stringer 112–114 using removable setting/spacing blocks 714. This form of two piece stringer/riser/tread support assembly can be assembled with the stringers 112–114 and the riser/tread supports 712 in place by attachment means at the pivots 712A and with the riser/tread supports spaced by the body 716 of setting/spacing blocks 714 mating and cooperating extensions 718A and 718B with centering slots 720A and 720B in the riser/tread supports. When the assembly is to be used, the setting/spacing blocks can then be removed from the riser/tread supports and the stringers can then slid with respect to each other to rotate the riser/tread supports about their pivot points. The stringer can then be attached to the face of the deck or wall where the stair is to be attached and the stringers can be cut (at possible cut lines shown) to face against the deck or wall. The riser/tread supports will then be equally spaced both vertically and horizontally, can be attached by suitable fastening means to the stringers, and are in position for installation of risers and treads.

FIGS. 26–33 illustrate another alternative form for a riser/tread support bracket 812. This form may be formed from a metal or other suitable material blank 812A with stamped holes, slots and side portions to from the bracket. The side portions 813 and 814 form the tread and riser support surfaces (respectively) with stamped holes 815 for attaching means for the treads and risers. Pivot holes 816 are used for connecting the bracket to the stringers and holes 817 are for fixing the bracket in place when a stringer assembly is completed. The bracket 812 is provided with stamped alignment guide holes at 819 and a guide slot at 820.

FIGS. 27–30 illustarte a setting and spacing bar 822. The setting and spacing bar may be formed of metal or other suitable material and includes a central body portion 823 with folded ears 824 at each side and with a guide tab 825 formed at each end of the body portion.

The setting and spacing bar 822 is adapted to cooperate with and space two brackets 812 by aligning the guide tab 825 with the guide hole 819 at one bracket and with guide slot 820 in the next bracket and serves to establish the spacing between brackets. The folded ears 824 separate two stringers and thus to allow for the space for relative movement between stringers.

With at least a pair of brackets 812 spaced by setting and spacing bars 822 and an upper and lower stringer the brackets may be attached by suitable means to the stringers at the pivot holes 816 to provide aligned and spaced riser/tread brackets for a stair assembly as will be described with reference to FIGS. 34–38.

Figure 5:
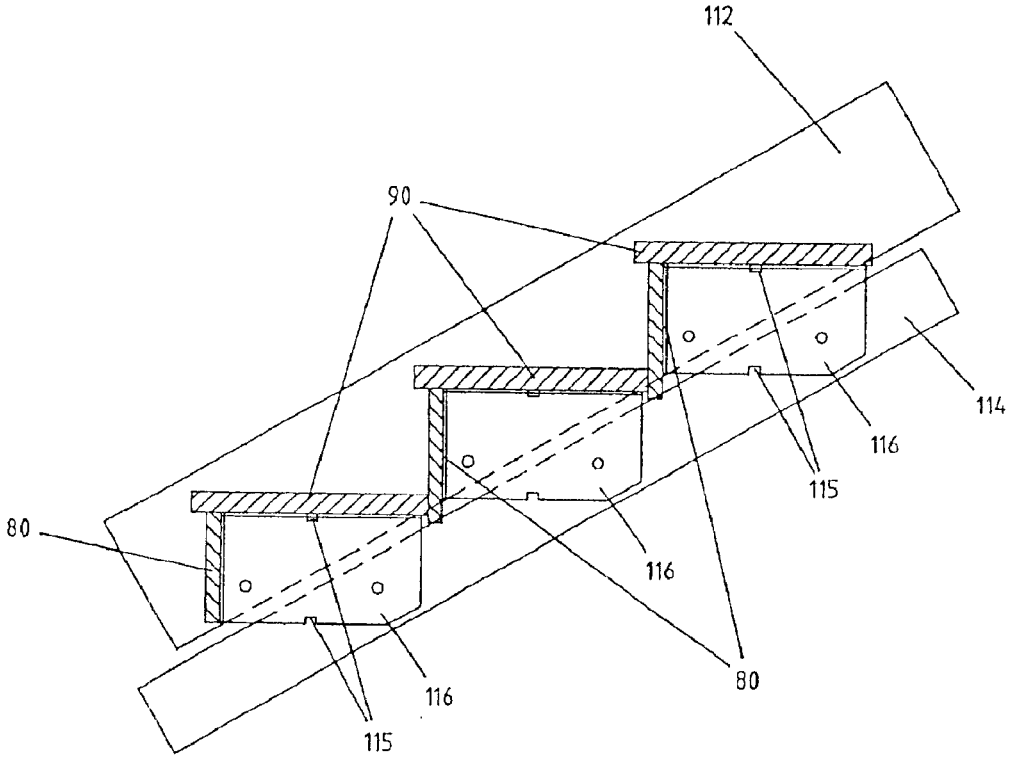
FIG. 5 is a side view showing the assembled stairs.

FIGS. 30–33 illustrate alternative forms for riser/tread brackets similar to that shown in FIGS. 26–29. FIG. 31 illustrates a bracket 812 with a setting and spacing bar 822 integrally formed with the bracket. The bar 822 has a length designed to space adjacent brackets and a near central folded ear portion 824 for spacing stringers. The bar 822 would be detachable after it has functioned in setting and spacing. FIG. 31 illustrates another alternative of an integrally formed bracket 812 with a removable spacing bar 822 and a central setting body 824. FIG. 32 is another alternative bracket similar to FIG. 31 with a removable spacing bar 822 and a central plug 826 for spacing the stringers. FIG. 33 illustrates alternative forms for the end of a spacing bar 822 to adapt the bracket to different spacings of brackets along a stringer assembly. The spacing bar may include holes or pins at 822A or notches at 822B. Spacing bars of the type shown here can be used with the brackets 116 shown in FIG. 5 by cooperating with the spacer slots 115 in positioning brackets 116 before stringers 112 and 114 are moved relative to each other in setting the brackets 116 for receiving treads and/or risers.

FIGS. 34–36 illustrate the use of the brackets with stringers in the formation of a stair assembly. FIGS. 34A and 34B illustrate the opposite sides of a stair stringer assembly, each side having an upper 112 and lower 114 stringer with a plurality of brackets 812 of the type illustrated in FIGS. 26–29 (or of the types shown in FIGS. 1–25) and employing setting and spacing bars 822 to position the brackets along the stringers. The two stringer assemblies mirror each other to be left and right sides of a stairway. When assembled, spaced and guided, the brackets are attached to the stringers by suitable means through pivot holes 316. FIGS. 35A and 35B illustrate the moved portion of the stringers 812–814 and the rotation of the brackets 812 to the desired position for attachment to a deck or wall and for tread and riser attachment after cutting the stingers for attachment to the deck or wall. At this stage in the formation of the stringer assembly the brackets 812 can be premanently attached to the stringers at the provided attachment holes.

Figures 36A, 36B:
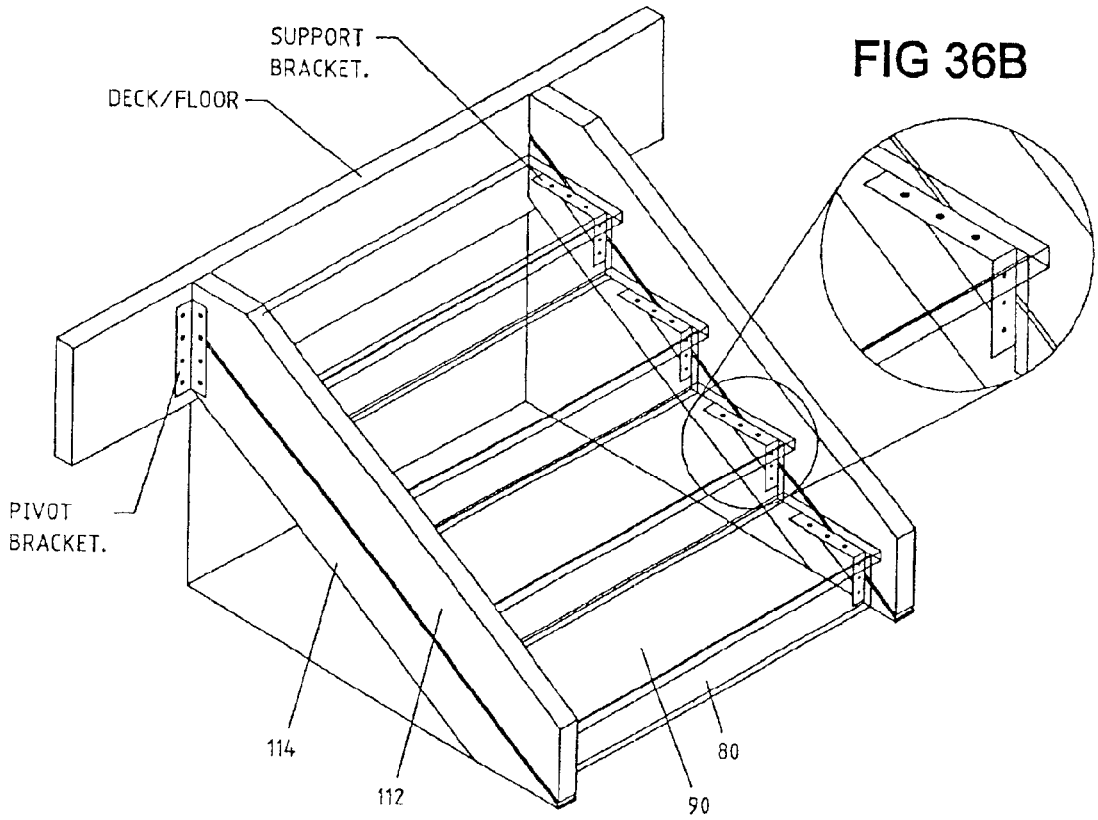

FIGS. 36A and 36B illustrate the completed stair using the brackets and movable stringers of the present invention. It should be noted that the forward holes 815 along the tread side portions 813 of the bracket of FIG. 26 permit the location for predrilling guide holes into a tread from below. By knocking the tread against the bracket, the raised holes will mark the underside of the tread. Predrilling guide holes will permit ease of assembly of the tread from below before a riser is added to the face of the stair.

Figure 37:
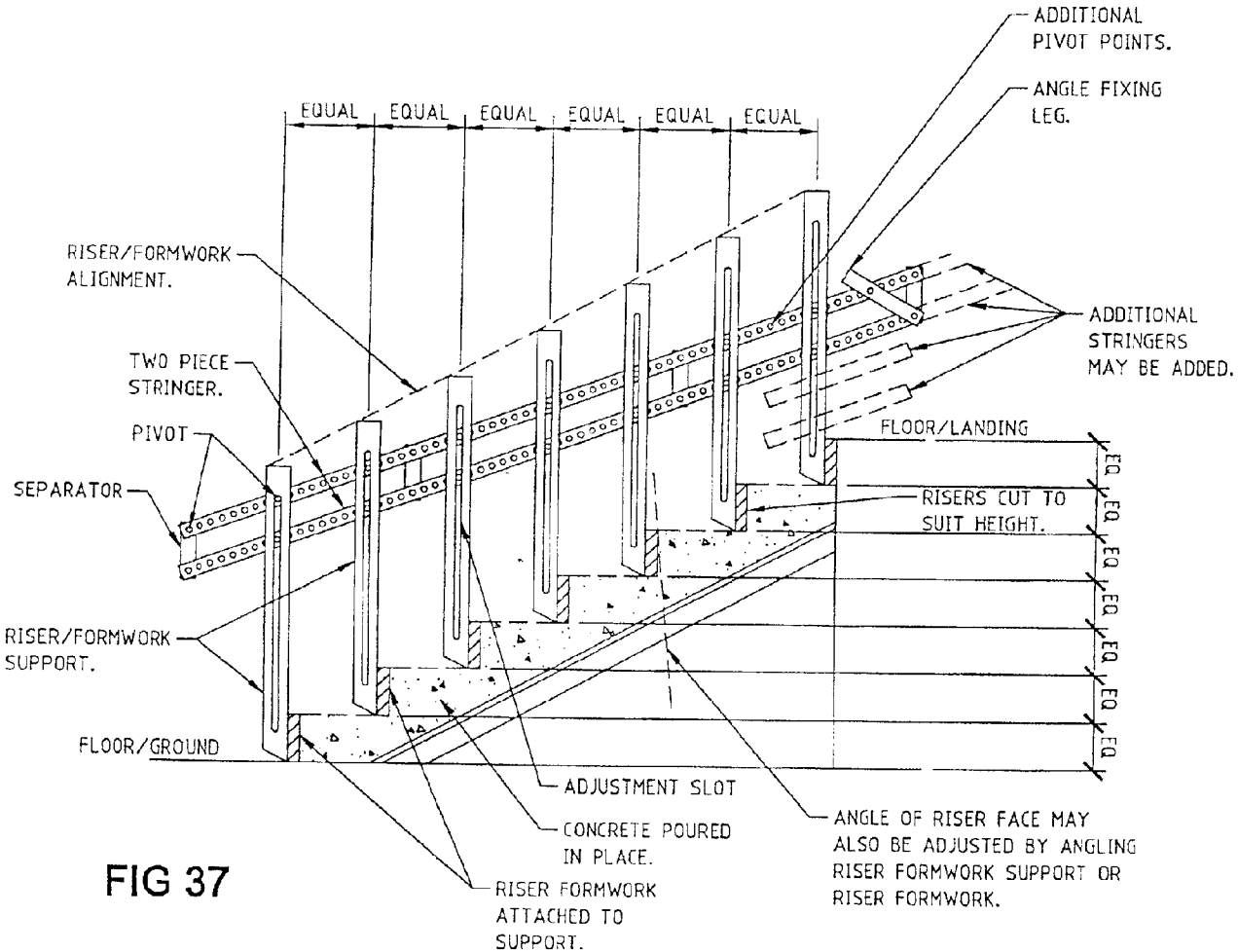
FIGS. 37, 38A and 38B are side elevation views of riser formwork and locking clamp using a two piece stinger and riser/formwork supports.
Figure 38A:
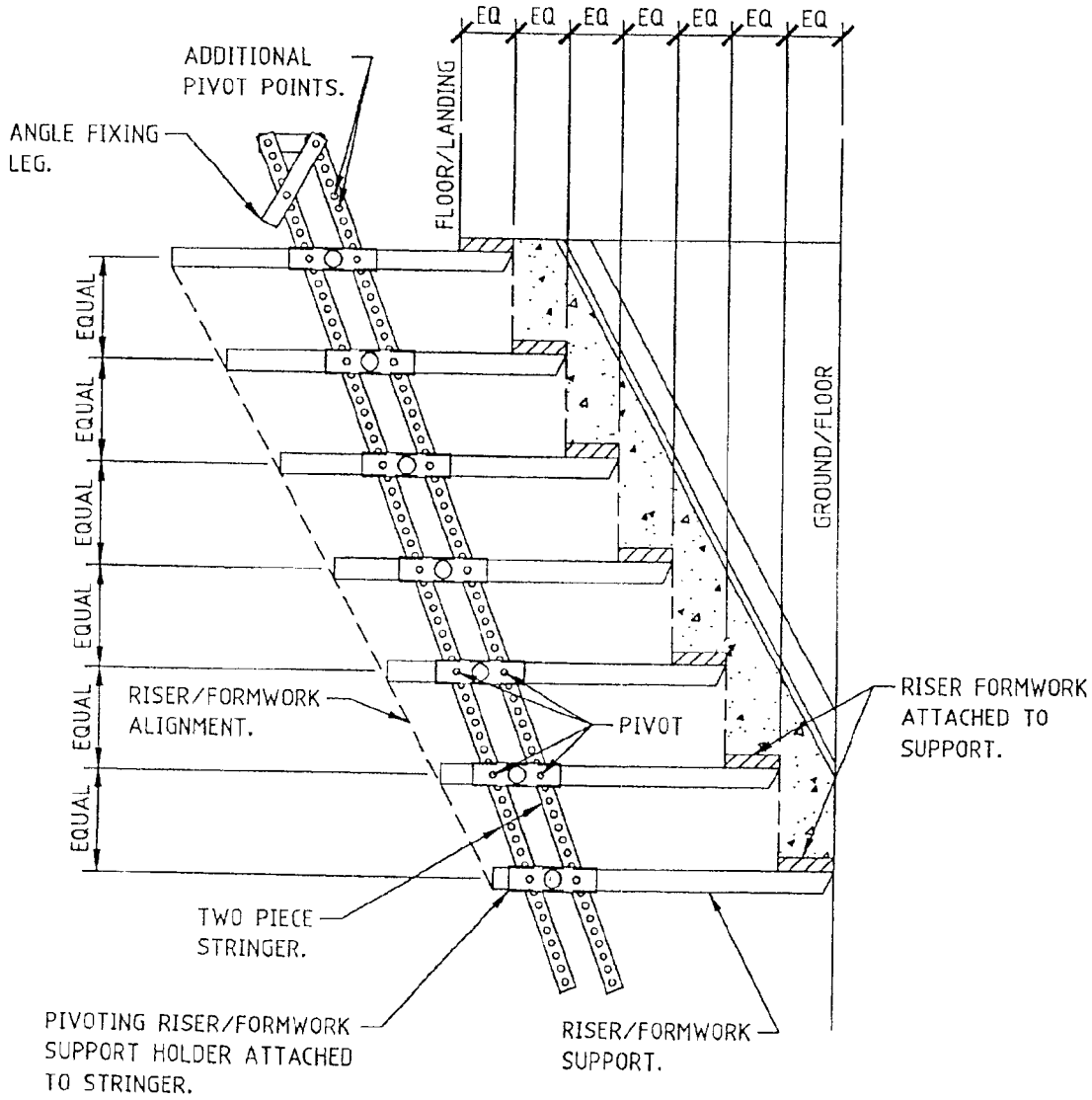
Figure 38B:
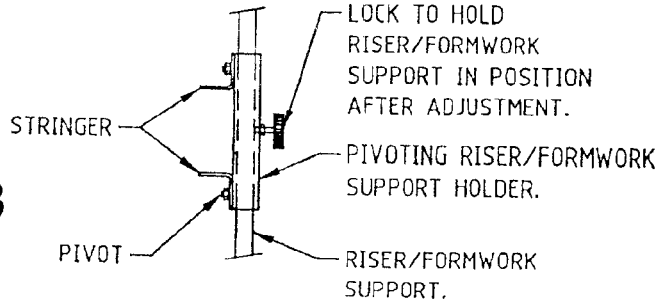

FIGS. 37 and 38A illustrate the use of the principle of the present invention for the positioning of formwork for poured concrete stairs. The use of two part parallel stingers with pivoted riser/formwork supports permits the setting of equally spaced horizontal riser forms and equally spaced vertical spaces between poured stairs. The two piece stringer is first set at the desired angle and the separated stinger parts are fixed with respect to the top and bottom of the desired stair. Equally spaced riser/formwork supports are positioned along the risers by attachment at pivot points with the support elements having adjustment slots (FIG. 37) or by the use of locking holders (FIG. 38B). Riser formwork elements are attached to the free end of each of the supports. Concrete aggregate can then be poured behind each of the riser formworks to the desired level for the stairs and allowed to set. It should be evident that the face of the riser formwork elements can be adjusted to a desired angle other than vertical by adjusting the relative positions of the two stringer elements. The riser height adjustment can be achieved by setting the first and last support and their riser formworks in position and then raising or lowering intermediate supported riser formworks to a string line drawn from the first to the last support. Equally spaced horizontal supports will then result in equally spaced vertical riser formworks.

A additional use for the parallel stringers, brackets and spacers is illustrated in FIGS. 39A, 39B, 39C and 39D for the setting of forms for pouring concrete in the formation of a concrete stair. Previous forming systems have required that stingers be set at each side of the stairs to be poured along with form boards for the vertical forms of the stair. With the use of the parallel stringers, brackets and spacers of the present invention, the form work for a stair is easily position and aligned. As with the case of the riser/tread setting of a stairway, the brackets are placed and spaced on the parallel stringers so that all brackets move parallel with eachother and provide a surface for the mounting of riser forms.

Figures 39A, 39B, 39C, 39D:
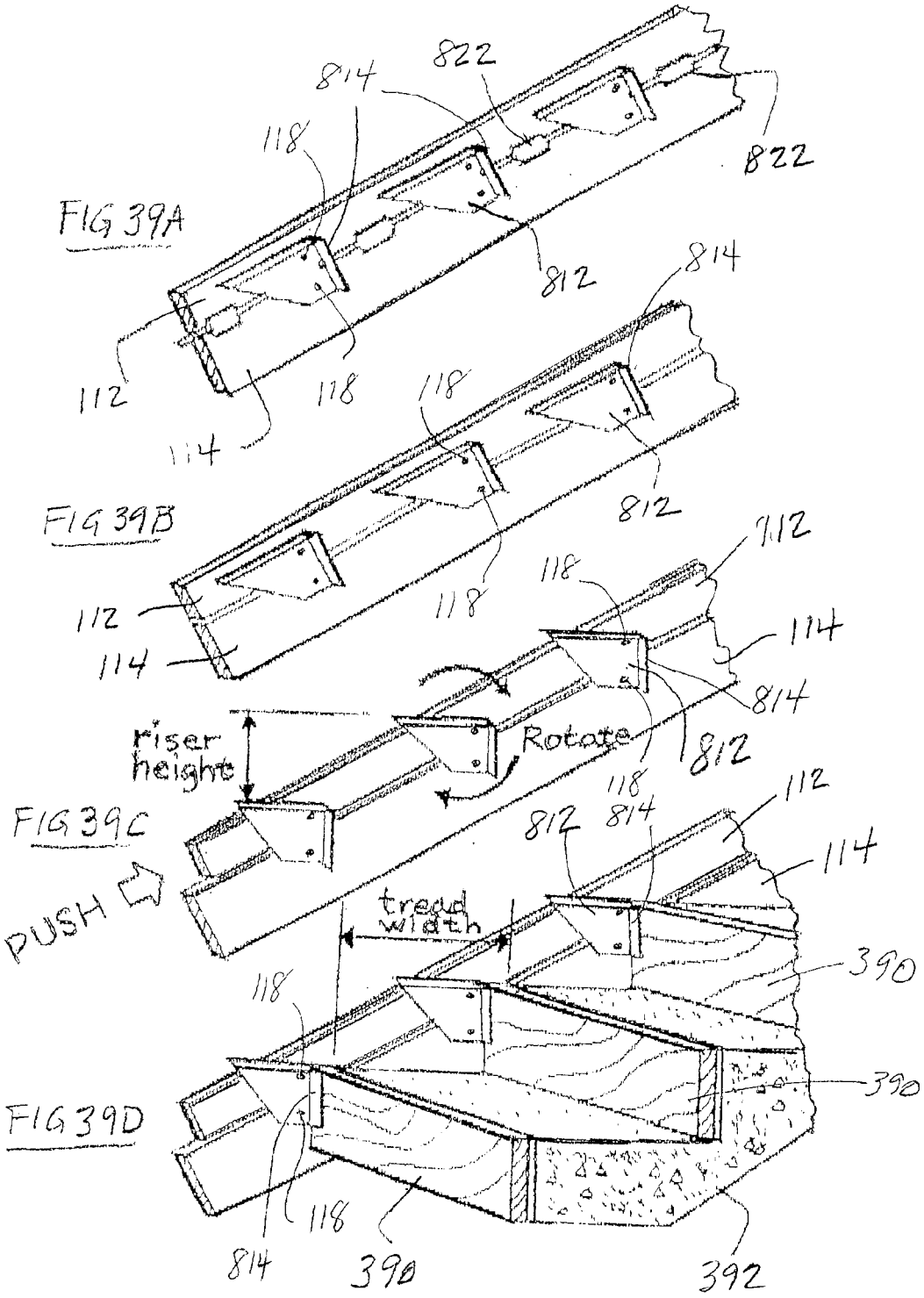
FIGS. 39A, 39B, 39C and 39D illustrate the forming for concrete stairway using the bracket and spacer of the present invention.

As illustrated in FIG. 39A, the parallel stringers 112 and 114 (as shown in FIG. 1) are set with brackets 812 and spacers 814 (as shown in FIGS. 26 through 35B) so that the brackets are equally spaced and pivoted about mounting fasteners 118 (FIG. 1) in each of the parallel stringers 112 and 114. Note that the brackets are mounted in a reverse position from that shown in the previous figures because the only surface that will be needed in the form work is the vertical surface 814 (FIG. 26) where a riser form 390 is to be attached. When set in place, the spacers are removed as shown in FIG. 39B so that the brackets are free to be rotated with the movement of the parallel stringers. As illustrated in FIG. 39C, when the parallel stringers are moved with respect to each other, the brackets are rotated parallel to each other. The vertical surfaces 814 of the brackets 812 are then parallel to each other and spaced equally along the formwork. With the stringer assembly set and fixed in place for the deaired angle of rise for the stairway, the vertical surfaces are positioned for the mounting of a riser form 390 at each bracket. It should be understood that the surface 814 need not be exactly vertical if it is desired that the riser part of a stair be tilted slightly from vertical.

FIG. 39D illustrates in perspective one side of a poured concrete stariway with aggragate 392 poured along the deaired stariway and finished against the riser forms 390 and leveled between riser forms. The parallel stringers, riser forms and brackets may then be removed for reuse after the concrete aggregate has become set. The tread width and riser heights will all be equal in the finished stairway.

While certain preferred embodiments of the invention have been specifically disclosed, it should be understood that the invention is not limited thereto as many variations will be readily apparent to those skilled in the art and the invention is to be given its broadest possible interpertation within the terms of the following claims.

We claim:

1. A method for forming an adjustable stair assembly having a pair of parallel stringers and employing a plurality of riser/tread support brackets adjacent to each other along said parallel stringers, and individual means for spacing and aligning said riser/tread support brackets with respect to adjacent riser/tread support brackets along said parallel stringers, said riser/tread support brackets being duplicate elements defining said riser/tread support brackets and having at least a reference surface, side surfaces, and means for accommodating fastening means, said means for spacing and aligning said adjacent riser/tread support brackets along said parallel stringers comprising an elongated spacer bar having an integrally formed first portion cooperating with said reference surface of adjacent riser/tread support brackets to establish spacing and alignment of adjacent riser/tread support brackets and a second portion integrally formed with said spacer bar and extending laterally therefrom cooperating with said parallel stringers to establish spacing and lateral positioning of said parallel stringers, said method comprising the steps of:

a) positioning said pair of stringers parallel to each other, b) placing said plurality of riser/tread support brackets on said parallel stringers with said reference surfaces generally aligned along said stringers, c) spacing and aligning said riser/tread support brackets along a first of said parallel stringers using said individual spacing and alignment means, the first portion of said individual spacing and alignment means cooperating at one end with said reference surface on each one of said riser/tread support bracket in a predetermined position and cooperating at the opposite end with said reference surface of an adjacent riser/tread support bracket, and said second portion of said spacing and alignment means cooperating with adjacent surfaces of said parallel stringers to space and laterally position said parallel stringers with respect to each other, d) pivotally fixing said riser/tread support brackets to said parallel stringers using a pair of fastening means through said means for accommodating fastening means with one of said pair of fastening means in each of said parallel stringers, e) removing said first portion of each spacing and alignment means from said riser/tread support brackets and removing said second portion of said spacing and alignment means tram said cooperating with said parallel stringers, f) and axially moving one of said parallel stringers with respect to the other to simultaneously pivotally rotate each of said riser/tread support brackets to a desired position along said adjustable stair assembly.

2. The method of claim 1 wherein said integrally formed first portion of said individual spacing and alignment means cooperates at one end with said reference surface, and wherein said reference surface is at the top of said riser/tread support bracket, and said integrally formed second portion of said alignment means cooperates with adjacent surfaces of said parallel stringers is a spacing pin positioned between said parallel stringers.

3. The method of claim 1, wherein said integrally formed first portion said individual spacing and alignment means cooperates at one end with said reference surface, and wherein said reference surface is side surfaces of adjacent support brackets and said second portion is an integral lateral extending ear positionable between said parallel stringers for spacing said parallel adjacent surface of said stringers.

4. A method for framing at least one side of a stair assembly into one of a plurality of configurations, the method comprising:

providing a first stringer and a second stringer;

providing a first support bracket and a second support bracket, each support bracket comprising a receptacle and a first aperture and a second aperture;

providing a spacer comprising an elongated member having a first element at each end thereof, and a second element integrally connected to the elongated member and extending laterally there from;

placing the spacer between the first stringer and the second stringer such that the second element of the elongated member is disposed at least partially between the first stringer and the second stringer and the first and second stringers are disposed generally parallel to one another;

placing the first element at one end of the spacer into the receptacle of the first support bracket to orient and position the support bracket with respect to the spacer;

placing the first element at the other end of the spacer into the receptacle of the second support bracket to orient and position the support bracket with respect to the spacer;

pivotally attaching each of the first and second support brackets to the first stringer by their respective first apertures; and pivotally attaching each of the first and second support brackets to the second stringer by their respective second apertures.

* * * * *

UNITED STATES PATENT AND TRADEMARK OFFICE

CERTIFICATE OF CORRECTION

PATENT NO. : 6,868,944 B2
APPLICATION NO. : 10/095780
DATED : March 22, 2005
INVENTOR(S) : Richard Truckner and Paul Truckner It is certified that error appears in the above-identified patent and that said Letters Patent is hereby corrected as shown below:

Title Page Item 57

IN THE ABSTRACT
Line 3, "tred" should be "tread"

IN THE CLAIMS
Col 10, line 11, "tram" should be "from"
line 23, "is" should be "as"
line 29 (?), insert between "said" and "parallel" – --adjacent surface of said--
line 30, cancel "adjacent surface of said"

Signed and Sealed this

First Day of January, 2008

JON W. DUDAS
*Director of the United States Patent and Trademark Office*